US007820272B2

(12) United States Patent
Torikoshi et al.

(10) Patent No.: US 7,820,272 B2
(45) Date of Patent: Oct. 26, 2010

(54) IMAGE TRANSFER SHEET FOR ELECTROPHOTOGRAPHY, AND IMAGE RECORDED MEDIUM, AS WELL AS METHOD FOR MANUFACTURING THE SAME

(75) Inventors: Kaoru Torikoshi, Minamiashigara (JP); Tomoo Kobayashi, Minamiashigara (JP); Kunio Sakurai, Ashigarakami-gun (JP); Naoyuki Egusa, Ashigarakami-gun (JP); Tetsuro Kodera, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 761 days.

(21) Appl. No.: 11/169,123

(22) Filed: Jun. 29, 2005

(65) Prior Publication Data

US 2006/0216497 A1 Sep. 28, 2006

(30) Foreign Application Priority Data

Mar. 28, 2005 (JP) ..... 2005-093326

(51) Int. Cl.
*B41M 5/00* (2006.01)
*B44C 1/17* (2006.01)
*G03G 7/00* (2006.01)

(52) U.S. Cl. ..... 428/195.1; 428/201; 428/210; 428/211.1; 428/323; 428/914; 399/127; 399/130

(58) Field of Classification Search ..... 428/195.1, 428/201, 210, 211.1, 323, 914; 399/127, 399/130
See application file for complete search history.

(56) References Cited

U.S. PATENT DOCUMENTS 5,437,913 A * 8/1995 Asaka et al. ..... 428/195.1
5,593,939 A * 1/1997 Saito et al. ..... 503/227
5,842,097 A 11/1998 Kanbayashi et al.
6,387,481 B1 * 5/2002 Matsuzaki et al. ..... 428/323
6,723,444 B2 4/2004 Kobayashi et al.
7,052,817 B2 5/2006 Sakurai et al.
2002/0045031 A1 * 4/2002 Takeuchi et al. ..... 428/195
2004/0161690 A1 8/2004 Sakurai et al.
2004/0185192 A1 9/2004 Tsuji et al.

(Continued)

FOREIGN PATENT DOCUMENTS

CN 1196302 A 10/1998

(Continued)

OTHER PUBLICATIONS

Office Action issued in Japanese Patent Application No. 2005-093326 on Mar. 9, 2010 (with English-Language Translation).

*Primary Examiner*—Betelhem Shewareged
(74) *Attorney, Agent, or Firm*—Oliff & Berridge, PLC

(57) ABSTRACT

An image transfer sheet for electrophotography comprising a substrate and an image receiving layer provided on at least one side of the substrate, wherein the image receiving layer includes particles having a volume average particle diameter which is greater than a thickness of the image receiving layer, and both surfaces of the image transfer sheet have surface resistivities at 23° C. 55% r.h. which are within the range of $1.0\times10^{8}$ to $1.0\times10^{13}\Omega$. Also provided are an image recorded medium and a method for manufacturing the image recorded medium which use the image transfer sheet for electrophotography.

15 Claims, 3 Drawing Sheets

U.S. PATENT DOCUMENTS

| | | | |
|---|---|---|---|
| 2006/0165920 | A1 | 7/2006 | Nakanishi |
| 2007/0031650 | A1 | 2/2007 | Kobayashi et al. |

FOREIGN PATENT DOCUMENTS

| | | | |
|---|---|---|---|
| CN | 1467573 | A | 1/2004 |
| CN | 1523454 | A | 8/2004 |
| JP | 05-096871 | A | 4/1993 |
| JP | A-05-289390 | | 11/1993 |
| JP | 07-068812 | A | 3/1995 |
| JP | A-7-160032 | | 6/1995 |
| JP | 08-142365 | A | 6/1996 |
| JP | 08-156302 | A | 6/1996 |
| JP | A-09-022137 | | 1/1997 |
| JP | 09-314875 | A | 12/1997 |
| JP | 10-086562 | A | 4/1998 |
| JP | 11-291646 | A | 10/1999 |
| JP | 11-334265 | A | 12/1999 |
| JP | 2001-092255 | A | 4/2001 |
| JP | A-2001-092255 | | 4/2001 |
| JP | A-2002-072530 | | 3/2002 |
| JP | B2 2359962 | | 10/2002 |
| JP | B2 3359963 | | 10/2002 |
| JP | A-2003-127529 | | 5/2003 |
| JP | A-2004-351660 | | 12/2004 |
| JP | A-2005-4029 | | 1/2005 |
| WO | WO 2004/069549 | A1 | 8/2004 |

* cited by examiner

IMAGE TRANSFER SHEET FOR ELECTROPHOTOGRAPHY, AND IMAGE RECORDED MEDIUM, AS WELL AS METHOD FOR MANUFACTURING THE SAME

CROSS-REFERENCE TO RELATED APPLICATION

This application claims priority under 35 USC 119 from Japanese patent Application No. 2005-93326, the disclosure of which is incorporated by reference herein.

BACKGROUND OF THE INVENTION

1. Field of the Invention

The present invention relates to an image transfer sheet for electrophotography for forming (recording) a clear image on an image supporting element by using an image formation apparatus of the electrophotographic method, an image recorded medium using the same, and a method for manufacturing the image recorded medium. More specifically, the present invention relates to an image transfer sheet for electrophotography for forming a printed image. The printed image may be used for image recorded media, such as information recording media containing personal information and image information of the non-contact or contact type. Such image recorded media may be facial-photograph-containing cash cards, employee identification cards, student identification cards, individual membership cards, resident identification cards, various types of driver's licenses, various types of qualification certificates, and the like. The printed image may be use also for RFID tags, and for image recorded sheets for personal identification and image display boards used in medical settings, and for indication labels, and the like. The invention also relates to an image recorded medium using the same, and a method for manufacturing the image recorded medium.

2. Description of the Related Art

In recent years, the image formation technology has developed. Currently, means are known which can form images of the same quality in large quantities at low cost by various printing methods, such as intaglio printing, letterpress printing, planographic printing, gravure printing, and screen printing. Such printing methods are also widely used for manufacturing an information recording medium which stores predetermined information and which can communicate with an external device in a contact or non-contact manner, such as an IC card, a magnetic card, an optical card, and a card which is a combination thereof.

However, for example, the above-mentioned screen printing requires a lot of printing plates corresponding to the number of images to be printed. In the case of color printing, the required printing plates are further increased corresponding to the number of colors. Therefore, these printing methods are not suitable for individual pieces of personal identification information (including the facial photograph, the name, the address, the date of birth, the variety of licenses, and the like).

Against the above-mentioned problem, the most dominant image formation means currently used is the image formation method based on the printer or the like which employs a sublimation-type or melting-type heat-transfer method using an ink ribbon, or the like. However, while these can easily print personal identification information, these still have a problem that increase in the printing speed lowers the resolution, and increase in the resolution leads to decrease in the printing speed.

A heat-transfer method has been proposed which uses an intermediate transfer element for printing onto the image recording medium (as disclosed, for example in Japanese Patent Application Laid-Open (JP-A) No. 5-096871, JP-A No. 7-068812, JP-A No. 8-142365, JP-A No. 8-156302, JP-A No. 9-314875, and JP-A No. 11-291646). However, in any case, a thin colored layer transferred from the ink sheet is formed on the surface of the above-mentioned intermediate transfer element. A good image quality cannot be obtained unless the thin colored layer is properly transferred to the image recording medium. In addition, the image quality basically depends on the irregularities on the surface of the image recording medium. Therefore, in order to improve the adhesion to the image recording medium, a rubber-like elastic layer is provided on the intermediate transfer element. The image is transferred by pressure contact, so that the image quality is maintained. The surface layer of the intermediate transfer elements is basically designed to have releasability. However, because the surface layer has to be able to follow the deformation of the above-mentioned rubber-like elastic layer, a hard surface layer cannot be used. Therefore, specifically, a silicone rubber or fluorine rubber is used for the surface layer.

In image formation (printing) by the electrophotographic method, the surface of the image carrier is electrically charged uniformly, and then subjected to light exposure according to image signals, to form an electrostatic latent image based on the difference in potential between the exposed portion and the unexposed portion. Thereafter, electrostatic development is conducted with a color powder (an image forming material) called toner with the opposite polarity to (or with the same polarity as) that of the charge of the image carrier, thereby forming a visible image (a toner image) on the surface of the image carrier. In the case of a color image, the color image is created by repetition of this process a plurality of times or by processes conducted by a plurality of image formation units disposed in parallel to form a color visible image, and the color visible image is transferred to an image recording medium and fixed (immobilized, in other words, melting of the color powder mainly by heat followed by solidification thereof by cooling).

As described above, by the electrophotographic method, the electrostatic latent image on the surface of the image carrier is electrically formed based on the image signals. Therefore, it is possible to form the same image any number of times, and it is also possible to easily form different images. In addition, almost the entire toner image on the surface of the image carrier can be transferred to the image forming material transfer element or to the surface of the image recording medium. Moreover, a slight amount of toner image remaining on the surface of the image carrier can also be easily removed by means of a resin blade, a brush, or the like; accordingly, it is possible to easily produce prints for high-mix, low-volume production.

In addition, the above-mentioned toner is generally formed by fusing and mixing a thermally fusible resin and a pigment, as well as optional additives such as a charge control agent, and then pulverizing and atomizing the kneaded substance. Further, the electrostatic latent image in the electrophotographic method has a considerably higher resolution compared with the above-mentioned atomized toner, and a sufficient resolution on a par with the resolutions realized by the screen printing and the heat-transfer method using ink ribbon can be expected.

Also, a color image can be obtained by using color toners of four primary colors of cyan, magenta, yellow, and black and then mixing the toner images of the respective colors.

Theoretically, the same colors as realized in printing can be reproduced. In addition, in the above-mentioned color toner, the toner resin and the pigment can be relatively freely compounded, thereby enabling easy increase in light shielding property of the image.

In addition, there have been almost no studies on the heat resistance and light resistance of information recording media intended to be used outdoors. Particularly when a driver's license or the like is left in a car and exposed to direct sunlight, fading occurs if the image is a heat-transferred image using a dye as a coloring material. However, when a color image is formed by the electrophotographic method, pigments corresponding to the respective colors of cyan, magenta, yellow, and black used in the color toner have excellent light resistance. Therefore, the light resistance of the images formed by the electrophotographic method is considered to be sufficiently high. Likewise, if a heat-resistant toner is selected, the heat resistance of the image formed on an information recording medium is considered to be high enough to allow the information recording medium to be used outdoors.

On the other hand, the most widely used substrates (cores) used for various types of cards are currently vinyl chloride sheets. This is because vinyl chloride sheets are excellent in printing characteristics in conventional printing machines, because they are also excellent in suitability for embossing (process to raise or lower the character portions), and particularly because they are inexpensive. However, the above-mentioned vinyl chloride sheets have a problem that dioxins are generated when cards are incinerated by using a heating furnace or the like after being disposed of for expiration or the like. From the viewpoint of environmental compatibility, various types of sheet films are currently used more widely as alternatives to vinyl chloride cards.

If embossing is not carried out in the manufacturing of cards, conventional films such as biaxially stretched PET (polyethylene terephthalate) films can be used. However, in order to retain the functions of the conventional cards, embossing is often indispensable. Films currently used for embossing include: ABS resin films and polyolefin resin films, which soften at relatively low temperatures; a modified PET resin film called PETG, which is obtained by copolymerizing at least ethylene glycol, terephthalic acid, and 1,4-cyclohexane dimethanol; and films obtained by integrally forming a modified PET resin film and (a PET film, an amorphous PET resin film, or a polycarbonate resin film).

A method for producing prints has been proposed which uses the above-described electrophotographic apparatus and further uses a transfer sheet (as disclosed in U.S. Pat. No. 3,359,962 and U.S. Pat. No. 3,359,963). However, in the above-mentioned sheet, the surface resistivity of the thermal adhesion layer, which works an image receiving layer, is particularly high. Therefore, transfer of the image forming material to the surface of the sheet may be defective, whereby fine characters are not reproduced. In T-shirt printing, since a large design and a hue are reproduced, use of such a sheet is not problematic. However, it is impossible to reproduce on the sheet delicate information, such as a facial photograph and a two-point character to be recorded on an ID card. In addition, the charge caused by a high resistance is problematic since the charge easily attracts fiber waste, dust, dirt, and the like, which seriously affect the card quality. In addition, when the supporting element is a plastic film, the coefficient of friction between sheets is too high, whereby the sheets tightly adhere to one another and the transferability of the sheets is deteriorated.

On the other hand, a method has been proposed, for example in JP-A No. 2001-92255. In the method, in addition to various types of personal information, an invisible barcode is printed on a vinyl chloride sheet having a thickness of 250 μm or on a polyester sheet having a thickness of 280 μm by the electrophotographic method; then an over-film is superposed on each printed surface, and lamination is carried out by a hot-press machine.

However, in the above-mentioned sheet, the coefficient of friction between sheets is too high. Therefore, the sheets tightly adhere to one another, thereby deteriorating the transferability of the sheets. This poor transferability may stop the electrophotographic apparatus. Further, an insulator (a sheet) having a thickness of 250 μm or larger as mentioned above may cause an increased image defect because of insufficient transfer of the image forming material (toner) thereto. In addition, when the resin film which softens at a relatively low temperature is used for image formation by an electrophotographic apparatus, the following problem occurs: the tackiness develops during the fixing process because the fixing temperature is higher than the softening temperature of the film; and the film winds around the fixing apparatus, resulting in jamming. Further, the image forming material may offset to the fixing apparatus. Further, when fixing is continuously conducted on the sheet having a thickness of 250 μm or larger, the edge (corner) of the sheet may unnecessarily damage the fixing apparatus, causing necessity for frequently replacement of members.

As another example, a method has been proposed in which a mirror image of personal identification information is printed on an optically transparent sheet (as disclosed, for example in JP-A No. 11-334265). However, with respect to the optically transparent laminate sheet, the JP-A No. 11-334265 only teaches that at least a part the laminate sheet is preferably a biaxially stretched polyester film, ABS, or a film/biaxially stretched polyester film consisting of polyester, but may also be vinyl chloride.

Therefore, in this structure, since the film is simply an insulator, transfer of the image forming material to the surface of the film or the like may be defective, and a resolution cannot be as high as that realized by the heat-transfer method or the like. In addition, in this apparatus focusing on improved productivity, the laminate sheet to be used is in the form of a roll. Therefore, there is a problem that a lot of loss and waste inevitably occur in order to meet the need for urgent or high-mix production, such as when conducting different types of print for cards for one to several persons.

Further, when an information recording medium is manufactured by using these laminate sheets, a plurality of sheets are stacked, thereby increasing the total thickness. For example, it may be difficult to produce an information recording medium having a thickness of about 800 μm.

In addition, there have been almost no studies about the automation of the process of forming an image on the laminate sheet, of feeding and stacking the bases comprised of the laminate sheet having the image and a plastic, or of laminating the bases. Accordingly, it is necessary to design each of the above-mentioned processes and the manufacturing apparatus from the viewpoint of productivity improvement (see, for example, JP-A No. 10-86562).

Further, an image formation method has been proposed which uses a recognition-identification medium obtained by superposing an adhesive layer on a supporting element (a substrate), disposing a transparent sheet on this adhesive layer, and forming an image with a colorant between the supporting element and the transparent sheet. In this method, the total thickness of the image recognition medium is the sum of the thicknesses of the substrate, the transparent sheet, and the adhesive layer. When the image recognition medium is an IC card, a magnetic card, or the like, the respective thicknesses must be controlled to meet the specification of the card thickness (760 μm±80 μm). Particularly the substrate for an IC card contains an IC chip, an antenna, or the like, whereby the thickness of the substrate is often close to the limit of the specification for the card thickness. Therefore, this method has problems such as a problem that the card thickness is increased by the thickness of the transparent sheet and the thickness of the adhesion layer to exceed the specified thickness limit.

SUMMARY OF THE INVENTION

The present invention has been made in consideration of the above problems of the conventional techniques.

The invention provides an image transfer sheet for electrophotography. The image transfer sheet comprises a substrate and an image receiving layer provided on a surface of the substrate. The image receiving layer includes particles with a volume average particle diameter which is larger than the thickness of the image receiving layer. Both surfaces of the image transfer sheet have surface resistivities at 23° C. 55% r.h. (relative humidity) which are within the range of $1.0\times10^{8}$ to $1.0\times10^{13}$.

The invention also provides an image recorded medium. The image recorded medium is obtained by a process comprising: electrophotographically forming a mirror image of a desired image with an image forming material on the surface of an image receiving layer of an image transfer sheet for electrophotography comprising a substrate and the image receiving layer provided on the substrate; adhering the image receiving layer to a surface of an image supporting element by pressure and heat; and peeling the substrate off the image receiving layer after cooling and solidification of the image forming material. As a result, the image forming material is transferred to the image supporting element, so that the image information is recorded. The image transfer sheet for electrophotography comprises a substrate and an image receiving layer provided on a surface of the substrate, as described above. The image receiving layer includes particles having a volume average particle diameter which is larger than the thickness of the image receiving layer. Both surfaces of the image transfer sheet have surface resistivities at 23° C. 55% r.h. which are within the range of $1.0\times10^{8}$ to $1.0\times10^{13}\Omega$.

The invention further provides a method for producing an image recorded medium. The method comprises: electrophotographically forming a mirror image of a desired image with an image forming material on an image receiving layer of an image transfer sheet for electrophotography comprising a substrate and the image receiving layer provided on the substrate; disposing the image transfer sheet on an image supporting element such that the mirror image contacts the image supporting element to form a laminate; adhering the image receiving layer to the image supporting element by heat and pressure; and peeling the substrate off the image receiving layer after cooling and solidification of the image forming material. In this way, the image forming material is transferred to the image supporting element, and the image is recorded. The image receiving layer includes particles having a volume average particle diameter which is larger than the thickness of the image receiving layer. Both sides of the image transfer sheet have surface resistivities at 23° C. 55% r.h. which are within the range of $1.0\times10^{8}$ to $1.0\times10^{13}\Omega$. The image is formed on the side of the image transfer sheet which side has the image receiving layer. The image transfer sheet may have image receiving layers on both sides of the substrate.

The invention further provides a method for producing two image recorded media from one image transfer sheet for electrophotography. The method comprises: electrophotographically forming mirror images of desired images with an image forming material or with image forming materials on image receiving layers of an image transfer sheet for electrophotography comprising a substrate and the image receiving layers provided on both sides of the substrate; disposing image supporting elements on both sides of the image transfer sheet such that the image transfer sheet is sandwiched between the image supporting elements to form a laminate; adhering the image receiving layers to the image supporting elements by heat and pressure; and peeling the substrate off the image receiving layers after cooling and solidification of the image forming material(s). In this way, the image forming material is transferred to the image supporting elements, and the images are recorded. The image receiving layers each include particles having a volume average particle diameter which is larger than the thickness of the image receiving layer. Both sides of the image transfer sheet have surface resistivities at 23° C. 55% r.h. which are within the range of $1.0\times10^{8}$ to $1.0\times10^{13}\Omega$.

DESCRIPTION OF THE PRESENT INVENTION

Figure 1:
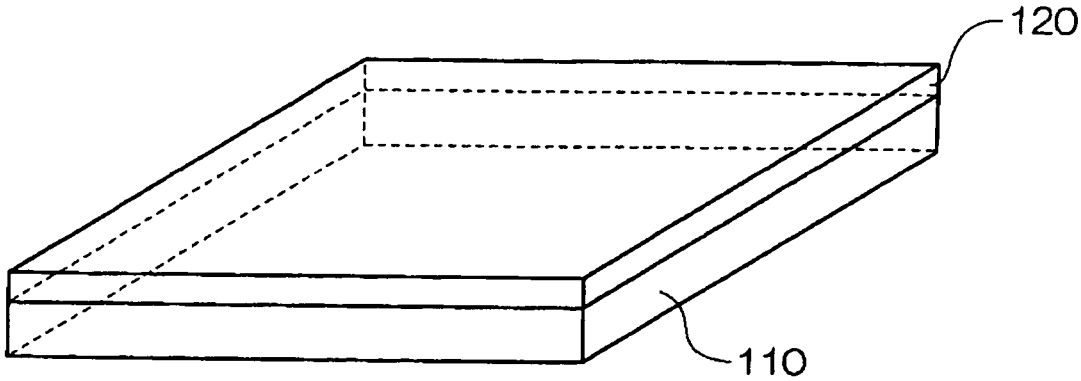
FIG. 1 is a schematic perspective view illustrating an example of the image transfer sheet for electrophotography of the present invention.

Hereinafter, the present invention will be described in detail.

(Transfer Sheet for Electrophotography)

The transfer sheet for electrophotography (hereinafter occasionally abbreviated to "transfer sheet") of the present invention is an image transfer sheet for electrophotography whose both surfaces have surface resistivities in the range of $1.0\times10^{8}$ to $1.0\times10^{13}\Omega$ at 23° C. 55% r.h. The transfer sheet comprises a substrate and an image receiving layer provided on a side of the substrate. The image receiving layer includes particles having a volume average particle diameter which is greater than the thickness of the image receiving layer.

The adhesion strength between the substrate and the image receiving layer may be 10 g/25 mm or lower. A releasing layer may be provided between the substrate and the image receiving layer. The image receiving layer may comprise a resin. In an embodiment, the resin is a thermoplastic resin, the thickness of the image receiving layer is 2 to 25 μm, and the adhesion strength between the releasing layer and the image receiving layer is 10 g/25 mm or lower. The image receiving layer may comprise a charge controlling agent, an antiseptic, an ultraviolet absorber, or an antioxidant. Further, the image receiving layer may comprise a polyester-based resin, an acrylic resin, or a polyvinyl acetal resin. The substrate may be paper, plastic, metal, or ceramic. The volume average particle diameter of the particles may be at least 1.2 times the thickness of the image receiving layer.

In an embodiment, image receiving layers are provided on both sides of the substrate.

When the surface resistivity is in the range of $1.0\times10^{8}$ to $1.0\times10^{13}\Omega$, satisfactory electrophotographic image formation can be carried out without occurrence of transfer defect or the like. On the other hand, when an image forming material with a surface resistivity of lower than $1.0\times10^{8}\Omega$ is used under a condition of a high temperature and a high humidity, the resistance of the image forming material transfer sheet as an image receiving element is too low. As a result, for example, the toner transfer from the primary transfer member in the electrophotographic apparatus does not proceed properly. Also, when the surface resistivity exceeds $1.0\times10^{13}\Omega$, the resistance of the image forming material transfer sheet as an image receiving element is too high. As a result, for example, the toner cannot be transferred from the primary transfer member in the electrophotographic apparatus to the surface of the transfer sheet, thereby causing image defects owing to transfer defects.

The surface resistivity is preferably in the range of $1.0\times10^{9}$ to $1.0\times10^{11}\Omega$.

The above-mentioned surface resistivity can be measured in accordance with JIS K6911 (which is incorporated herein by reference), using a circular electrode (for example, "HR Probe" of Hiresta IP manufactured by Mitsubishi Petrochemical Co., Ltd.) under a condition of 23° C. 55% r.h.

For the same reason, when the image receiving layer is provided only on one side of the substrate, the surface resistivity of the substrate surface not having the image receiving layer is preferably in the range of $1.0\times10^{9}$ to $1.0\times10^{11}\Omega$.

In addition, the difference in surface resistivity between the sides (the front and back sides) of the image transfer sheet at 23° C. 55% r.h. is preferably lower than $1.0\times10^{4}\Omega$; more preferably lower than $1.0\times10^{3}\Omega$. When the difference in surface resistivity between the front and back sides is $1.0\times10^{4}\Omega$ or higher, transfer of the toner tends to be defective, and the resultant image is likely to be of low quality.

In order to adjust the surface resistivity of the image receiving layer to a value within the range of $1.0\times10^{8}$ to $1.0\times10^{13}\Omega$, it is preferable to incorporate a charge control agent to the image receiving layer. The charge control agent may be, for example, a high-molecular electrically conductive agent, a surfactant, or electrically conductive metal oxide particles.

In the present invention, the image receiving layer preferably includes various types of materials, in addition to the silicone hardcoat material which is preferably used for the release layer to be described later. However, the proportion of the silicone hardcoat material to all the resins constituting the image receiving layer is preferably 0.5 to 98% by weight, more preferably 1 to 95% by weight. If the proportion of the silicone hardcoat material is lower than 0.5% by weight, a desired releasability may not be obtained. If the proportion of the silicon hardcoat material exceeds 98% by weight, the transfer and/or fixing condition of the image is likely to be poor, and the image quality may be deteriorated.

The image receiving layer preferably includes a resin. The resin is preferably a polyester resin, which is an organic resin. As mentioned above, the polyester resin is used in the image forming material. Accordingly, incorporation of a resin which is similar to the resin in the image receiving layer enables proper control of the fixability of the image forming material on the surface of the transfer sheet. The polyester resin may be, for example, a silicone-modified polyester resin, an urethane-modified polyester resin, an acryl-modified polyester, or a general polyester resin.

The method for synthesizing the polyester resin is not particularly limited. For example, the urethane-modified polyester resin can be obtained generally by: allowing a polybasic acid component having two or more carboxyl groups and a glycol component to undergo a condensation reaction, and then allowing the obtained saturated polyester to react with an organic diisocyanate compound and a chain elongating agent.

The polybasic acid may be, for example, an aromatic dicarboxylic acid, which is a dibasic acid, can be used. Examples thereof include terephthalic acid, isophthalic acid, orthophthalic acid, naphthalene dicarboxylic acid, biphenyl dicarboxylic acid, and 1,5-naphthalic acid. In addition, aromatic oxycarboxylic acids such as p-oxybenzoic acid and p-(hydroxyethoxy)benzoic acid, and tri- and tetra-aromatic carboxylic acids such as trimellitic acid and pyromellitic acid, are also usable.

Examples of the aliphatic dicarboxylic acid include succinic acid, adipic acid, sebacic acid, azelaic acid, dodecandioic acid, and dimer acid. Examples of the alicyclic dicarboxylic acid include 1,4-cyclohexane dicarboxylic acid, 1,3-cyclohexane dicarboxylic acid, 1,2-cyclohexane dicarboxylic acid, and anhydrides thereof.

In addition, a dicarboxylic acid having a polymerizable unsaturated double bond can also be used. Such a dicarboxylic acid may be: an α,β-unsaturated dicarboxylic acid such as fumaric acid, maleic acid, maleic anhydride, itaconic acid, or citraconic acid; or an alicyclic dicarboxylic acid containing an unsaturated double bond such as 2,5-norbornene dicarboxylic anhydride or tetrahydrophthalic anhydride. Among these, fumaric acid, maleic acid, itaconic acid, and 2,5-norbornene dicarboxylic anhydride are more preferable.

Further, a hydroxycarboxylic acid may be used such as hydroxypivalic acid, γ-butyrolactone, or ϵ-caprolactone, in accordance with the necessity. Only a single polybasic acid may be used, or two or more polybasic acids may be used in combination.

The glycol component may be, for example, at least one selected from aliphatic glycols each having 2 to 10 carbon atoms, alicyclic glycols each having 6 to 12 carbon atoms, and ether-bond-containing glycols.

Examples of the aliphatic glycol having 2 to 10 carbon atoms include ethylene glycol, 1,2-propylene glycol, 1,3-propanediol, 1,4-butanediol, 1,5-pentanediol, neopentyl glycol, 1,6-hexanediol, 3-methyl-1,5-pentanediol, 1,9-nonanediol, 2-ethyl-2-butylpropanediol, hydroxypivalic acid neopentyl glycol ester, and dimethylol heptane.

Examples of the alicyclic glycol having 6 to 12 carbon atoms include 1,4-cyclohexane dimethanol and tricyclodecane dimethylol.

Examples of the ether-bond-containing glycol include diethylene glycol, triethylene glycol, dipropylene glycol, and further, a glycol obtained by adding one to several ethylene oxide or propylene oxide residues to each of the two hydroxyl groups bonded to the aromatic ring of a bisphenol, such as 2,2-bis(4-hydroxyethoxyphenyl)propane. Polyethylene glycol, polypropylene glycol, and polytetramethylene glycol can also be used, in accordance with the necessity.

Examples of the organic diisocyanate compound include hexamethylene diisocyanate, tetramethylene diisocyanate, 3,3-dimethoxy-4,4'-biphenylene diisocyanate, p-xylylene diisocyanate, m-xylylene diisocyanate, 1,3-diisocyanate-methylcyclohexane, 1,4-diisocyanate-methylcyclohexane, 4,4'-diisocyanate dicyclohexylmethane, isophorone diisocyanate, 2,4-tolylene diisocyanate, 2,6-tolylene diisocyanate, p-phenylene diisocyanate, diphenylmethane diisocyanate, m-phenylene diisocyanate, 2,4-naphthalene diisocyanate, 3,3'-dimethyl-4,4'-biphenylene diisocyanate, 4,4'-diisocyanate diphenyl ether, and 1,5-naphthalene diisocyanate. Among these, hexamethylene diisocyanate, tetramethylene diisocyanate, isophorone diisocyanate, and diphenylmethane diisocyanate are preferable.

Examples of the chain elongating agent include ethylene glycol, propylene glycol, neopentyl glycol, 2,2-diethyl-1,3-propanediol, polyethylene glycol, diethylene glycol, polypropylene glycol, polytetramethylene glycol, tricyclodecane dimethylol, bisphenol A ethylene oxide adduct, and 1,4-cyclohexane dimethanol. Among these, ethylene glycol, polyethylene glycol, neopentyl glycol, diethylene glycol, and bisphenol A ethylene oxide adduct are more preferable.

The polyester resin may be synthesized by a known method. For example, the polyester resin may be synthesized in a solvent at a reaction temperature of 20 to 150° C. optionally using a catalyst, such as an amine or an organotin compound. Examples of the solvent include: ketones such as methyl ethyl ketone, methyl isobutyl ketone, and cyclohexanone; aromatic hydrocarbons such as toluene and xylene; and esters such as ethyl acetate and butyl acetate. Only a single polyester resin may be used, or two or more polyester resins may be used in combination.

In addition, a conventionally known resin may be mixed in the resin material for constituting the image receiving layer, in order to improve the blocking property or the like, in accordance with the necessity. The resin material is preferably a polyvinyl acetal resin.

The polyvinyl acetal resin to be used in the present invention refers to a polyvinyl alcohol (PVA) which has been acetalized. Typical examples of the polyvinyl acetal resin include: a polyvinyl butyral resin obtained by allowing PVA to react with butyl aldehyde; a polyvinyl formal resin obtained by allowing PVA to react with formaldehyde; and a partially formalized butyral resin (or partially butyralized formal resin) obtained by allowing butyl aldehyde and formaldehyde to react in a ratio which may be selected from a wide range. These polyvinyl acetal resins are substances obtained by acetalizing PVA, as mentioned above. However, PVA cannot be completely acetalized, and the theoretical limit of the degree of acetalization is considered to be 81.6 mol %, according to P. J. Flory. In addition, because a small amount of the acetyl group remains in manufacturing the PVA, the actual degree of acetalization is supposed to be slightly lower than the theoretical value. Therefore, polyvinyl acetal resins have different physical and chemical properties, depending on the degree of acetalization and the content of the hydroxyl group and the acetyl group. Further, the thermal and mechanical properties of polyvinyl acetal resins and the viscosities of the solutions containing polyvinyl acetal resins also vary, depending on the degree of polymerization.

For example, when the degree of acetalization is heightened, the solubility of the polyvinyl acetal resin in a solvent other than water is increased, whereby the water resistance of the polyvinyl acetal resin is improved. Further, it is known that a higher acetalization degree improves compatibility with esters and plasticizers and soften the polyvinyl acetal resin. In addition, as the degree of polymerization is increased, the strength of the coating film and the softening point is increased, and the viscosity of a solution containing the polyvinyl acetal resin is also increased.

When polyvinyl butyral resins and polyvinyl formal resins are compared, polyvinyl butyral resins have higher solubility in solvents, higher adhesion (adhesiveness), and higher plasticity, and polyvinyl formal resins have higher heat resistance, abrasion resistance and scratch resistance.

In the present invention, it is preferable to contain a polyvinyl acetal resin in the image receiving layer for reasons described below:

First, when a polyvinyl acetal resin is used in the image receiving layer, the adhesion (adhesiveness) of the image receiving layer to the substrate (a PET film or the like), and the adhesion of the image receiving layer to the image forming material are improved. In addition, the polyvinyl acetal resin has high affinity for the resin and release agent such as wax in a new color image forming material containing a large quantity of a release agent such as wax, and for the curable silicone resin and the later described release agent contained in the image receiving layer. Accordingly, the polyvinyl acetal resin is compatible with such substances, whereby the transparency of the coating film can be maintained. Further, when a reactive silane compound having a functional group, which is an example of the later described release agents, is used, the polyvinyl acetal resin undergoes a crosslinking reaction to form a three-dimensional structure, thereby improving the heat resistance and hardness of the surface. Therefore, the image receiving layer can endure repetitive fixing of image and peeling, and the image receiving layer can be used over a long period of time.

The average polymerization degree of the polyvinyl acetal resin is preferably in the range of 200 to 3,000, more preferably in the range of 300 to 2000. When the average polymerization degree is lower than 200, various functions as a macromolecule are not obtained; for example, the required coating film strength or the like are not achieved in some cases. Also, when the average polymerization degree exceeds 3000, the viscosity of the coating liquid is too high, and it may become difficult to control the thickness of the coating film.

In the present invention, it is preferable to use a mixture of at least two polyvinyl acetal resins having respectively different average polymerization degrees. Properties of the mixture of the resins can be controlled by adjusting the content ratio, the curing condition, the amount of addition, and the like, whereby it is possible to more freely control the image fixability, the image peelability, and the coating film strength.

The image receiving layer may comprise an acrylic resin. Examples thereof include styrene-acrylic copolymers, ethylmethyl methacrylate copolymers, urethane-modified acrylic resins based on combination with various types of isocyanates, and acrylic polyol resins obtained by graft-polymerization with alkyd resins.

The image receiving layer may comprise a known thermosetting resin which cures (becomes insoluble) when heated. Examples thereof include phenol-formaldehyde resin, urea-formaldehyde resin, melamine-formaldehyde resin, the resin obtained by curing acrylic polyol with isocyanate, the resin obtained by curing polyester polyol with melamine, and the resin obtained by curing acrylic acid with melamine. Monomers constituting the thermosetting resins may be used in combination to form another thermosetting resin.

In addition to these, a thermoplastic resin can also be used in the same manner as in the case of the above-mentioned thermosetting resins, provided that the thermoplastic resin cures by crosslinking to acquire heat resistance. Such a resin may be, for example, a thermosetting acrylic resin. The thermosetting acrylic resin may be obtained by crosslinking a polymer containing at least one acrylic monomer with a melamine compound or an isocyanate compound, or by crosslinking a copolymer obtained by polymerizing an acrylic monomer and a styrene monomer with a melamine compound or an isocyanate compound.

Examples of the acrylic monomer include: methacrylic acid alkyl esters such as methyl methacrylate, butyl methacrylate, octyl methacrylate, and stearyl methacrylate; acrylic acid alkyl esters such as ethyl acrylate, propyl acrylate, butyl acrylate, and octyl acrylate; acrylonitrile; and amino-group-containing vinyl monomers such as acrylamide, dimethylaminoethyl methacrylate, diethylaminoethyl methacrylate, dimethylaminoethyl acrylate, and dimethylaminopropyl methacrylamide. Examples of the styrene monomer include styrene, α-methyl styrene, vinyl toluene, and p-ethyl styrene.

Further, the image receiving layer in the present invention includes particles having a volume average particle diameter greater than the thickness of the image receiving layer, from the viewpoints of improving the transferability of the transfer sheet and of suppressing the effects on the image produced by the bubbles trapped when the transfer sheet is adhered to the image supporting element by heat and pressure. The volume average particle diameter of the particles is preferably not less than 1.2 times the thickness of the image receiving layer; and is more preferably not less than 1.6 times it. The volume average particle diameter of the particles is more preferably not more than 10 times the thickness of the image receiving layer. When the image receiving layer includes particles having a volume average particle diameter greater than the thickness of the image receiving layer, the coefficient of friction between image forming material transfer sheets in a stack is decreased, whereby the image forming material transfer sheet can be smoothly transferred in the electrophotographic apparatus and the surface of the transfer sheet is less likely to be worn or damaged. Further, the bubbles trapped upon adhesion of the image forming material transfer sheet to the image supporting element by heat and pressure are released, and their effects on the image can be suppressed. On the other hand, when the volume average particle diameter of the particles exceeds 10 times the thickness of the image receiving layer, the particles come off the image receiving layer (detachment of the particles), and, in some cases, the surface is easily worn and damaged.

The type of the particles is not limited as long as the particles have a volume average particle diameter within the range specified above. When the particles are organic resin particles, the organic resin may be a homopolymer of any of the following monomers, or a copolymer containing at least one of the following monomers: styrenes such as styrene, vinyl styrene, and chlorostyrene; mono-olefins such as ethylene, propylene, butylene, and isobutylene; vinyl esters such as vinyl acetate, vinyl propionate, vinyl benzoate, and vinyl butyrate; esters of α-unsaturated aliphatic monocarboxylic acid such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene monomers such as isoprene and 2-chlorobutadiene.

Among these, styrenes, esters of α-unsaturated aliphatic monocarboxylic acid, and the like are preferable. When such a thermally fusible resin is used as particles, the particles may be applied by using a solvent which does not dissolve the particles, and used as particles constituting a gloss control layer. However, particles are more preferably selected from particles obtained by atomizing a thermosetting resin having a crosslinked structure generated by addition of a crosslinking agent or the like to a thermally fusible resin, particles obtained by atomizing the previously described thermosetting resins, particles obtained by atomizing photocurable resins, and particles obtained by atomizing electron-beam curable resins and the like.

When the particles are inorganic particles, specific examples of the substance constituting the particles include mica, talc, silica, calcium carbonate, zinc white, hallosite clay, kaolin, basic magnesium carbonate, quartz powder, titanium dioxide, barium sulfate, calcium sulfate, and alumina.

As the shape of the particles, the spherical shape is common, but the particles may be plate-shaped, acicular, or amorphous.

The volume average particle diameter of the particles is preferably 0.1 to 30 μm.

The weight ratio of the particles to the binder (the resin component) in the image receiving layer of the image forming material transfer sheet is preferably in the range of 0.01:100 to 200:100, more preferably in the range of 0.5:100 to 100:100. When the proportion of the filler is within the above-mentioned range, there is less disorder in the transfer of the image forming material from the transfer sheet, and the image quality is superior. When the proportion of the filler is smaller than the above-mentioned range, the coefficient of friction between stacked transfer sheets is larger, and jamming may occur in the electrophotographic apparatus. When the filler proportion is greater than the above-mentioned range, the image may not be transferred properly at the transfer of the image forming material.

Next, the substrate to be used in the present invention will be described.

The above-mentioned substrate is not particularly limited, and is typically a plastic film. The plastic film is preferably a polyacetate film, a cellulose triacetate film, a nylon film, a polyester film, a polycarbonate film, a polysulfone film, a polystyrene film, a polyphenylene sulfide film, a polyphenylene ether film, a cycloolefin film, a polypropylene film, a polyimide film, cellophane, or an ABS (acrylonitrile-butadiene-styrene) resin film since such a film is transparent enough to be used for OHP films.

Among the above-mentioned various types of plastic films, a polyester film is preferable. The polyester film is preferably a film called PETG The PETG film is obtained by substituting approximately half of the ethylene glycol component in the raw material of PET (polyethylene terephthalate formed from ethylene glycol and terephthalic acid) with 1,4-cyclohexane methanol component and then conducting copolymerization. Also preferable are polyester films obtained by incorporating polycarbonate to PETG to form an alloy, an amorphous polyester called A-PET, which is a PET which has not been biaxially stretched, and the like.

The polyester resin obtained by copolymerizing at least ethylene glycol, terephthalic acid, and a 1,4-cyclohexane dimethanol component (hereinafter occasionally referred to as "PETG resin") is excellent in compatibility with the components such as a resin contained in the coating liquid used for forming an image receiving layer on the surface of the substrate. Therefore, when the substrate has a surface formed of a material including a PETG resin, the surface firmly adheres to the image receiving layer provided in contact with the surface, and can prevent the image receiving layer from peeling off.

Considering the thermocompression-bondability (laminatability) to the later-described image supporting element, the substrate to be used in the present invention preferably consists of two or more layers.

In an exemplary embodiment, a PETG resin is contained at least in the layer constituting the outer surface of the substrate, and such a layer may consist only of the PETG resin.

Because the softening point of a PETG resin is near 80° C., thermocompression bonding can be carried out easily. Therefore, the layer containing a PETG resin is excellent in laminatability.

However, in this temperature range, a layer containing a PETG resin, particularly, a layer consisting only of a PETG resin, is easily deformed. Also for suppression of such deformation, the substrate preferably consists of a layer containing a PETG resin and a layer consisting of a component other than a PETG resin. As the material to constitute the latter layer, it is preferable to use a polyester resin having a softening point higher than that of the PETG resin. Preferable examples of such a material include polycarbonate, polyallylate, a mixture or a copolymer thereof, and polyethylene terephthalate (PET). Particularly, a PET film which has been subjected to biaxial stretching has a high stiffness and resistance to deformation even upon heating. Thus, when a layer (film) containing a PETG resin is combined with a layer (film) which has a high stiffness and resistance to deformation even upon heating, winding of the transfer sheet around the fixing device during fixing of the image can be easily prevented.

In the above materials, polycarbonate is a polycondensate obtained from bisphenol and carbonic acid, and polyallylate is a polyester obtained by polycondensation of bisphenol and an aromatic dicarboxylic acid. Polyallylate generally has a higher heat resistance than polycarbonate because polyallylate contains a rigid aromatic ring in the main chain at a high density.

Examples of the bisphenol include bisphenol A (2,2-bis(4-hydroxyphenyl)propane), bisphenol C (4,4'-(1-methylethylidene)bis(2-methylphenol)), bisphenol AP (4,4'-(1-phenylethylidene)bisphenol), bisphenol Z (4,4'-cyclohexylidene bisphenol), 4,4'-cyclohexylidene bis(3-methylphenol), 5,5'-(1-methylethylidene) (1,1'-biphenyl)-2-ol, (1,1'-biphenyl)-4,4'-diol, 3,3'-dimethyl (1,1'-biphenyl)-4,4'-diol, 4,4'-(1,4-phenylene bis(1-methylethylidene))bisphenol), 4,4'-(1,4-phenylene bis(1-methylethylidene)bis(2-methylphenol)), 4,4'-(1,3-phenylene bis(1-methylethylidene)bis(2-methylphenol)), and bisphenol S (4,4'-bis(dihydroxy diphenyl sulfone). Bisphenol A is often used. Only a single bisphenol may be used, or a mixture of two or more bisphenols may be used.

Examples of the aromatic dicarboxylic acid include terephthalic acid, isophthalic acid, oxalic acid, malonic acid, succinic acid, adipic acid, itaconic acid, azelaic acid, sebacic acid, eicosanedioic acid, naphthalene dicarboxylic acid, diphenic acid, dodecanedioic acid, and cyclohexane dicarboxylic acid. Only a single aromatic dicarboxylic acid may be used, or two or more aromatic dicarboxylic acids may be included in the copolymer components. When a mixture of a bisphenol with a terephthalic acid component and/or an isophthalic acid component is used, the resultant polyallylate has a preferable melt-processability and a preferable total performance. In such a mixture, the mixing ratio thereof can be arbitrarily selected. The mixing ratio of the terephthalic acid component to the isophthalic acid component is preferably in the range of 9/1 to 1/9 (in molar ratio), particularly in the range of 7/3 to 3/7 (in molar ratio) considering the balance between the melt-processability and the performance, and is more preferably 1/1 (in molar ratio).

Although the method for manufacturing the substrate to be used in the present invention is not particularly limited, the substrate can be manufactured by using a well-known method such as a co-extrusion method or a lamination method. Particularly, substrates manufactured by the co-extrusion method are preferable because the adhesion strength between layers is strong. For example, the method described below can be employed for manufacturing a substrate if the substrate is a lamination including: film 1 (layer I) made of polycarbonate, polyallylate, a copolymer thereof, or PET, and film(s) 2 (layer(s) II) made of PETG resin which is/are provided on one side or both sides of film 1.

In an exemplary method, the composition to constitute film 1 (layer I) and the composition to constitute film 2 (layer II) are supplied to separate extruding machines and then the molten compositions are extruded from the same die in the stacked state. An unstretched film can be obtained by this coextrusion method. By the method, film 2 (layer II) is provided on one side of film 1 (layer I), or films 2 (layers II) are provided on both sides of film 1 (layer I).

The unstretched film obtained above can be used as a substrate as it is. Alternatively, the unstretched film may be additionally subjected to biaxial orientation before being used as a substrate. The biaxial orientation may be conducted, for example, by stretching the film between rolls different in speed (roll stretching), by stretching the film by gradual expansion with a grasping clip (tenter stretching), or by stretching the film by expansion under air pressure (inflation stretching).

Generally, when manufacturing a substrate, the co-extrusion operation is followed by a longitudinal stretching process in which: the film is stretched between two or more rolls different in the peripheral velocity to adjust the film thickness to the desired thickness, and then the film is wound up. In the case of a biaxial stretching, the film which has undergone the above-mentioned process is, as it is, introduced into a tenter and stretched to 2.5- to 5-fold in the crosswise direction. The preferable stretching temperature at this time is in the range of 100° C. to 200° C.

The biaxially stretched film thus obtained is subjected to heat treatment, as required. It is preferable that the heat treatment be carried out in a tenter, and particularly when it is heat-treated while being loosened in the longitudinal and crosswise directions, a film with a lower heat shrinkage factor is obtained.

FIG. 1 is a schematic perspective view illustrating an example of the image transfer sheet for electrophotography according to the present invention.

As shown in FIG. 1, an example of the image transfer sheet for electrophotography of the present invention comprises a substrate 110 and an image receiving layer 120. However, if necessary, the image transfer sheet may have a coating layer (a charge control layer) (not shown) or a layer similar to the image receiving layer 120 on the surface of the substrate 110 on which surface the image receiving layer 120 is not provided. When the image receiving layer 120 is provided on the surface of the substrate 110, the surface roughness of the surface of the substrate 110 is directly reflected in the surface roughness of the surface of the image receiving layer 120.

In an example of the image transfer sheet for electrophotography of the present invention, the adhesion strength of the image receiving layer 120 to the substrate 110 is preferably 10 g/25 mm or lower. When the adhesion strength of the image receiving layer 120 to the substrate 110 is 10 g/25 mm or lower, an image can be easily transferred from the image transfer sheet for electrophotography to an element (another substrate film) to which the image is to be transferred, by heat and/or pressure. The adhesion strength is more preferably 8 g/25 mm or lower. By selecting the material for the substrate 110 and the material for the image receiving layer 120, the adhesion strength of the image receiving layer 120 to the substrate 110 can be adjusted to a value within the range of 10 g/25 mm or lower.

In an example of the image transfer sheet for electrophotography of the present invention, a toner image (a mirror image of a desired image) is formed on the image receiving layer disposed on the surface of the substrate, then the surface having the toner image is brought into contact with an element (another substrate film) to which the toner image is to be transferred. Then, the toner image and the image receiving layer are transferred to the element by applying heat and/or pressure to the boundary of the films, thereby forming such an image on the element that the image is seen as a normal image (an ordinary image) when viewed from the side of the image receiving layer. For example, a reverse image (a mirror image) is formed on the transfer sheet such that the image is seen as a normal image (an ordinary image) when the image is viewed through the image receiving layer 120 from the opposite surface of the image receiving layer to the surface having the image thereon. By using such an image transfer sheet for electrophotography, the normal image and the image receiving layer are provided in this order on the element, and the image receiving layer plays the role of a so-called overcoat layer and makes it possible to form a highly durable image.

In the image transfer sheet for electrophotography of the present invention, it is preferable to provide a release layer between the substrate and the image receiving layer. The release layer contains a release material, and the release material is not only capable of satisfactorily transferring an image forming material such as described below to the image supporting element, but also excellent in the image fixing characteristics in the electrophotographic method. The image receiving layer may comprise such a release material regardless of the existence of the release layer.

Therefore, according to the present invention, an image forming material transfer sheet for electrophotography is provided which enables formation of a high quality image by the electrophotographic method.

The release layer may comprise a resinous material. The image forming material is once fixed and immobilized on the image receiving layer of the transfer sheet, and then the image transfer sheet is thermocompression-bonded to an image supporting element. Then, the image forming material and the image receiving layer are released from the release layer.

Such a release material is not particularly limited. The release material is preferably a silicone hardcoat material.

The silicone hardcoat material to be used in the present invention comprises a condensate resin containing at least a silane composition, or a mixture composition of the condensate resin and a colloidal silica dispersion liquid. In order to improve the adhesion to the substrate, silicone hardcoat material may further comprise an organic resin.

The silane composition is specifically an organic silicon compound, and examples thereof include silane compounds, fluorine-containing silane compounds, and isocyanate silane compounds. Such an organic silicon compound forms a resin composition through condensation reaction.

Examples of the silane compounds include: alkoxysilanes such as $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$, $Si(OC_2H_5)_4$, $CH_3Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3(CH_3)_{11}Si(OC_2H_5)_3$, $CH_3(CH_2)_{15}Si(OC_2H_5)_3$, and $CH_3(CH_2)_{17}Si(OC_2H_5)_3$; silazanes such as $(CH_3)_3SiNHSi(CH_3)_3$; special silylating agents such as $((CH_3)SiNH)_2CO$ and tert-$C_4H_9(CH_3)_2SiCl$; silane coupling agents; and silane compounds such as $HSC_3H_6Si(OCH_3)_3$; as well as hydrolysates and partial condensates thereof.

Examples of the silane coupling agents include: vinyl silanes such as vinyl tris(β-methoxyethoxy)silane, vinyltriethoxysilane, and vinyltrimethoxysilane; acryl silanes such as γ-methacryloxypropyltrimethoxysilane; epoxy silanes such as β-(3,4-epoxycyclohexyl)ethyltrimethoxysilane and γ-glycidoxypropylmethyldiethoxysilane; and amino silanes such as N-β-(amino ethyl)-γ-aminopropylmethyldimethoxysilane, γ-aminopropyltriethoxysilane, and N-phenyl-γ-aminopropyltrimethoxysilane.

Examples of the fluorine-containing silane compounds include: fluorine-containing silane compounds such as $CF_3(CH_2)_2Si(OCH_3)_3$, $C_6F_{13}C_2H_4Si(OCH_3)_3$, $C_7F_{15}CONH(CH_2)_3Si(OC_2H_5)_3$, $C_8F_{17}C_2H_4Si(OCH_3)_3$, $C_8F_{17}C_2H_4SiCH_3(OCH_3)_2$, $C_8F_{17}C_2H_4Si(ON{=}C(CH_3)(C_2H_5))_3$, $C_9F_{19}C_2H_4Si(OCH_3)_3$, $C_9F_{19}C_2H_4Si(NCO)_3$, $(NCO)_3SiC_2H_4C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$, and $(CH_3O)_2(CH_3)SiC_9F_{18}C_2H_4Si(CH_3)(OCH_3)_2$; and silane compounds such as hydrolysates and partial condensates of the above fluorine-containing silane compounds.

Examples of the isocyanate silane compounds include $(CH_3)_3SiNCO$, $(CH_3)_2Si(NCO)_2$, $CH_3Si(NCO)_3$, vinylsilyltriisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, and $(NCO)_3SiC_2H_4(NCO)_3$.

Examples of the condensate resin of a silane composition in the present invention include curable silicone resins such as thermosetting (condensation type and addition type) silicone resins and photocurable silicone resins. Specific examples thereof include the resins described below.

Among the thermosetting silicone resins, examples of the condensation-type curable silicone resin include: a curable silicone resin synthesized by providing a polysiloxane having silanol groups at terminals thereof as a base polymer such as polydimethylsiloxane, adding a crosslinking agent such as polymethyl hydrogen siloxane, and causing the condensation reaction by heating the mixture in the presence of an organic acid metal salt such as an organotin catalyst, an amine, or the like; a curable silicone resin synthesized by causing a reaction of a polydiorgano siloxane having reactive functional groups such as a hydroxyl group or an alkoxy group at terminals thereof; and a polysiloxane resin synthesized by condensation of a silanol obtained by hydrolyzing a tri- or higher-functional chlorosilane, or by hydrolyzing a mixture of a tri- or higher-functional chlorosilane and a mono- or di-functional chlorosilane.

The condensation-type curable silicone resins are classified into the solution-type and the emulsion-type, based on their forms. Both can be used advantageously.

Among the thermosetting silicone resins, examples of the addition-type curable silicone resin include a curable silicone resin synthesized by: providing a polysiloxane, such as polydimethylsiloxane, having a vinyl group as a base polymer, adding polydimethylhydrogensiloxane as a crosslinking agent, and allowing them to react and cure in the presence of a platinum catalyst.

The addition-type curable silicone resins are classified into the solvent type, the emulsion type, and the non-solvent type, based on their forms. Any of the types can be used advantageously.

Preferable examples of the thermosetting silicone resin obtained by the condensation-type or addition-type curing include pure silicone resins, silicone alkyd resins, silicone epoxy resins, silicone polyester resins, silicone acrylic resins, silicone phenolic resins, silicone urethane resins, and silicone melamine resins.

Examples of the photocurable silicone resins include: a curable silicone resin synthesized by using a photo-cation catalyst; and a curable silicone resin synthesized by using a radical-curing mechanism. It is also preferable to use a modified silicone resin obtained by allowing a low molecular weight polysiloxane having a hydroxyl group, an alkoxy group, or the like bonded to a silicon atom to react with an alkyd resin, a polyester resin, an epoxy resin, an acrylic resin, a phenolic resin, a polyurethane, a melamine resin, or the like to undergo a photocuring reaction. Only a single photocurable silicone resin may be used, or two or more photocurable silicone resins may be used in combination.

As the curable silicone resins, it is preferable to use an acryl-modified silicone resin (a resin obtained by allowing the acrylic resin to react with a low molecular weight polysiloxane to undergo a photocuring reaction) or a thermosetting silicone resin, for the following reasons.

The acryl-modified silicone resin contains an acrylic chain having a high chemical affinity for a styrene-acrylic resin and a polyester resin, which are generally used as image forming materials; on the other hand, the resin also has a silicone resin moiety, which provides releasability. Therefore, a moiety which easily binds to the toner and a moiety which poorly binds to the toner exist in a single molecule. Because the moieties are distributed uniformly, image fixability and image releasability are imparted on the molecular level.

When the acryl-modified silicone resin is used, a transfer sheet having an adequate surface hardness can be manufactured by properly controlling the ratio of the acrylic chain to the silicone chain in the acryl-modified silicone resin, the curing condition for the resin, and the like.

For the above-mentioned reasons, it is preferable to use a thermosetting silicone resin, particularly, an acryl-modified silicone resin.

As the curable silicone resins, an acryl-modified silicone resin and a thermosetting silicone resin may be simultaneously contained.

When an acryl-modified silicone resin and a thermosetting silicone resin are simultaneously contained, it becomes possible to obtain properties which are in between the properties of the respective resins, and the obtained properties can be controlled by the content ratio between the resins, the curing condition, the amounts of the resins to be added, and the like, whereby the image fixability, and the image peelability can be controlled more freely.

When the curable silicone resin simultaneously contains an acryl-modified silicone resin and a thermosetting silicone resin, the content ratio by weight between the resins (the ratio by weight of the acryl-modified silicone resin to the thermosetting silicone resin) cannot be specified uniquely because an adequate ratio varies depending on the type of the curable silicone resin and the like. In general, the ratio is preferably in the range of 1/100 to 100/1, more preferably in the range of 1/10 to 10/1.

In addition, when the curable silicone resin simultaneously contains an acryl-modified silicone resin and a thermosetting silicone resin, preferable examples of the combination include: a combination of an acryl-modified silicone resin and a silicone alkyd resin; a combination of an acryl-modified silicone resin and a pure silicone resin; and a combination of an acryl-modified silicone resin, a silicone alkyd resin, and a pure silicone resin.

The molecular weight of the curable silicone resin is preferably in the range of 10,000 to 1,000,000 in terms of a weight-average molecular weight. The proportion of the phenyl group in all the organic groups in the curable silicone resin is preferably in the range of 0.1 to 50 mole %.

In a preferable embodiment, the silicone hardcoat material in the present invention further comprises colloidal silica in an amount of approximately 5 to 25 parts (more preferably approximately 10 to 15 parts) per 100 parts of the solid content of the condensate resin of the above-mentioned silane composition. When colloidal silica is used in such an amount, cracks do not occur in the image receiving layer and an optimal mechanical strength can be achieved.

The colloidal silica is generally in the form of an aqueous dispersion liquid or in the form of a dispersion in an aqueous/organic solvent. Methods for manufacturing the colloidal silica are disclosed, for example, in U.S. Pat. No. 4,914,143, U.S. Pat. No. 3,986,997, U.S. Pat. No. 5,503,935, and U.S. Pat. No. 4,177,315, the disclosures of which are incorporated herein by reference.

The colloidal silica has an average particle diameter of less than approximately 10 nanometer (nm) when observed with a transmission electron microscope or the like. Further, on a particle volume basis, at least approximately 80% of the colloidal silica particles have a diameter in the range of 6 to 9 nm.

When the image receiving layer is provided only on one side of the substrate, the surface resistivity of the substrate surface not having the image receiving layer can be controlled, for example, by: adding a surfactant, a high-molecular electrically conductive agent, electrically conductive particles, or the like, to the resin in the production of the film as the substrate; by coating the surface of the film as the substrate with a surfactant; by vapor depositing a metal thin film on the film as the substrate; or by adding an adequate amount of a surfactant or the like to the adhesive.

Examples of usable surfactants include: cationic surfactants such as polyamines, ammonium salts, sulfonium salts, phosphonium salts, and betaine amphoteric salts; anionic surfactants such as alkyl phosphate; and nonionic surfactants such as fatty acid esters. Among these surfactants, use of a cationic surfactant is effective for improving the transferability since the cationic surfactant interacts strongly with negatively-charged toner for electrophotography used currently.

Among the above-mentioned cationic surfactants, a quaternary ammonium salt is preferable. The quaternary ammonium salt is preferably a compound represented by the following formula (I):

Formula (I)

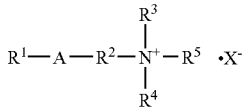

In the formula (I), $R^1$ represents an alkyl, alkenyl, or alkynyl group having 6 to 22 carbon atoms, and $R^2$ represents an alkyl, alkenyl, or alkynyl group having 1 to 6 carbon atoms. $R^3$, $R^4$, and $R^5$ may be the same or different, and each represents an aliphatic group, an aromatic group, or a heterocyclic group. The aliphatic group refers to a linear, branched, or cyclic alkyl, alkenyl, or alkynyl group. The aromatic group refers to a benzene monocyclic aryl group or a condensed polycyclic aryl group. These groups each may have a substituent such as a hydroxyl group. In formula (I), A represents an amide bond, an ether bond, an ester bond, or a phenyl group, but can be omitted. $X^-$ represents a halogen element, a sulfate ion, or a nitrate ion; such an ion may have a substituent.

When the image forming material transfer sheet of the present invention comprises a release layer, the thickness of the image receiving layer is preferably 2 to 25 μm and the adhesion strength between the release layer and the image receiving layer is preferably 5 g/25 mm or lower. When the adhesion strength between the release layer and the image receiving layer is 5 g/25 mm or lower, the image can be easily transferred from the image transfer sheet to the element (another substrate film) to which the image is to be transferred, by heat and/or pressure. The adhesion strength is more preferably 4 g/25 mm or lower. By selecting the materials of the release layer and the image receiving layer, the adhesion strength between the release layer and the image receiving layer can be set at a value in the range of 5 g/25 mm or lower.

The layer constitution of the image forming material transfer sheet of the present invention is not particularly limited provided that it has a substrate and an image receiving layer provided on at least one side of the substrate, as already mentioned. In a preferable embodiment, a release layer is provided between the substrate and the image receiving layer. Hereinafter, the image forming material transfer sheet of the present invention having the release layer will be described in detail with reference to the drawings. However, the constitution of the image forming material transfer sheet for electrophotography of the present invention is not limited to the constitution shown below.

Figure 2:
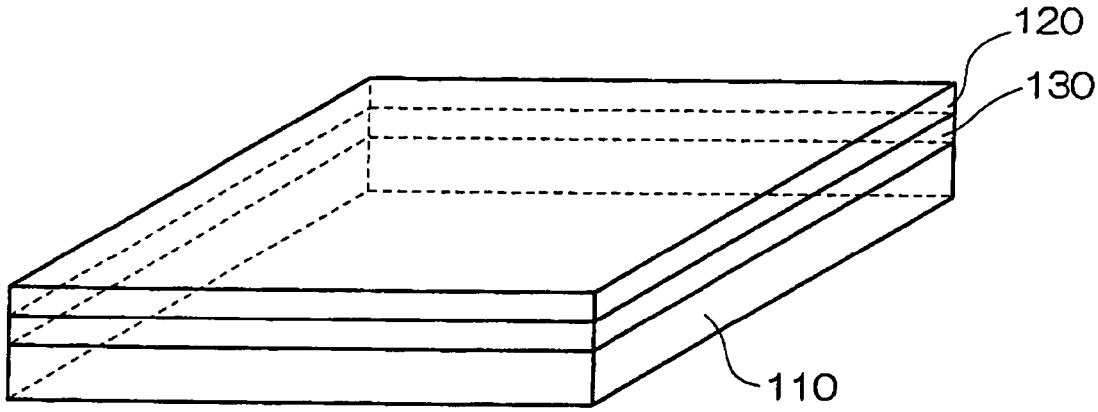
FIG. 2 is a schematic perspective view illustrating another example of the image transfer sheet of the present invention.

FIG. 2 is a schematic perspective view illustrating another example of the image transfer sheet of the present invention. The image transfer sheet of the present invention shown in FIG. 2 comprises a substrate 110, a release layer 130, and an image receiving layer 120.

In this example of the image transfer sheet of the present invention, for example, a fixed reverse image (a mirror image) is formed on the surface of the image receiving layer 120 such that the image on the image supporting element is a normal image (an ordinary image) when the fixed reverse image is transferred to the image supporting element.

Each constituent member of the image transfer sheet of the present invention will be described in more detail.

The substrate 110 which can be used for the image transfer sheet of the present invention does not have to be transparent. Here, transparency refers to, for example, a property of transmitting light in the visible light range to some degree. When transparency is required in the present invention, the transparency is sufficient if the formed image can be viewed through the substrate 110 from the surface opposite to the surface having thereon the image. Such a level of transparency makes it easy to check the alignment of the image transfer medium, and errors, displacement, and the like in the information to be printed.

Preferable examples of the substrate 110 include papers (such as plain paper and coated paper), metals (such as aluminum), plastics, and ceramics (such as alumina). The form of the substrate is not particularly limited and may be suitably selected from well-known forms of substrates. The substrate is preferably in a film form.

The paper may be chemical pulp. Examples thereof include a hardwood bleached kraft pulp, a hardwood unbleached kraft pulp, a hardwood bleached sulphite pulp, a coniferous bleached kraft pulp, a coniferous unbleached kraft pulp, a coniferous bleached sulphite pulp, and virgin bleached chemical pulps fabricated by chemically processing of woods and other fiber raw materials, and then subjecting them to the bleaching process, such as soda pulp. Among these, pulps having high whiteness are particularly preferable. In addition, examples of the recycled pulp include: recycled pulps obtained by disintegrating unprinted high white paper, special white paper, middle white paper, white broke, and the like, which occur in bookbinding, printing factories, paper-cutting sites, and the like, and recycled pulps obtained by disintegrating and then adequately deinking the following: waste high quality paper, high quality coated paper, middle quality paper, middle quality coated paper, woody paper, or the like, printed by planography, letterpress, intaglio printing, or the like, or by electrophotographic method, thermosensitive method, thermal transfer method, pressure-sensitive recording paper, ink jet recording method, carbon paper, or the like; waste paper written in aqueous or oil-based ink, pencil, or the like; and waste newspaper. Among these, recycled pulp having a higher whiteness and containing less impurities is particularly preferable.

As the substrate 110, a plastic film can be used preferably. Conventionally, polyvinyl chloride has been used as a substrate (core) material for cards. However, polyvinyl chloride has begun to be recognized as an environmentally unfavorable substance. This is because polyvinyl chloride generates dioxins when burnt as a combustible waste. As a result, polyvinyl chloride is used less and less. The plastic film material used in the invention does not have such a problem. In the present invention, considering the problems related to use of chlorine, a substrate free of chlorine such as described above may be used. It is also preferable to use a films obtained by adding a hot-melt adhesive such as polyester or EVA to a polystyrene resin film as described above, an ABS resin film, an AS (acrylonitrile-styrene) resin film, a PET film, or a polyolefin resin film such as polyethylene or polypropylene.

The material used in combination with the PETG resin may be the plastic film described above, another resin having a transparency, or ceramics having transparency. Such a material may be colored by incorporation of a pigment, a dye, or the like. The substrate 110 may be in the form of a film or a plate. The substrate 110 may have a thickness which makes the substrate inflexible or a thickness which makes the substrate strong enough to have strength generally required for an image transfer sheet.

In order to prevent adhesion to the fixing member or winding around the fixing member during fixing of the image, the image receiving layer 120 may comprise a natural or synthetic wax which is a material which does not adhere to the fixing member strongly, or a release agent such as a release resin, a reactive silicone compound, or a modified silicone oil.

Specific examples of the wax include: natural waxes such as carnauba wax, beeswax, montan wax, paraffin wax, and microcrystalline wax; synthetic waxes such as low molecular weight polyethylene wax, low molecular weight oxidized polyethylene wax, low molecular weight polypropylene wax, low molecular weight oxidized polypropylene wax, higher fatty acid wax, higher fatty acid ester wax, and Sasol wax. Only a single type of wax may be used, or two or more waxes may be used in combination.

As described above, the image receiving layer may comprise the release resin. The release resin may be selected from: silicone resins; fluororesins; modified silicone resins which are modification products of silicone resins and various types of resins, such as polyester-modified silicone resin, urethane-modified silicone resin, acryl-modified silicone resin, polyimide-modified silicone resin, olefin-modified silicone resin, ether-modified silicone resin, alcohol-modified silicone resin, fluorine-modified silicone resin, amino-modified silicone resin, mercapto-modified silicone resin, and carboxy-modified silicone resin; thermosetting silicone resins; and photocurable silicone resins.

The above-mentioned modified silicone resin has high affinity for the resin particles as an image forming material comprising a toner resin or a thermally fusible resin. Accordingly, the modified silicone resin and the image forming material are suitably miscible with each other, compatible with each other, and can mix with each other when heated. Thus, the color of the pigment contained in the toner is exhibited well. Further, it is considered that the releasing property imparted by the silicone resin prevents adhesion between the fixing member and the transfer sheet during heat fusion.

Further, in the present invention, in order to further decrease the adhesiveness, a reactive silane compound and a modified silicone oil may be included in the image receiving layer 120. It has been found that the reactive silane compound reacts with the resin contained in the image receiving layer 120, and simultaneously reacts with the modified silicone oil, whereby the combination of the reactive silane compound and the modified silicone oil exhibits a releasing property which is stronger than the releasing property derived from the silicone oil as a liquid lubricant. Further, the combination undergoes a curing reaction to be firmly immobilized in the image receiving layer as a release agent, and the release agent does not come off the image receiving layer even when subjected to mechanical wear, solvent extraction, or the like.

The wax or release resin may be present in the particle state or the like, similarly to the case of the resin particles made of a thermally fusible resin. In a preferable embodiment, the wax or release agent is added to, dispersed in, and mixed with a thermally fusible resin to be incorporated in the thermally fusible resin before use.

As already mentioned, the surface resistivity of the image receiving layer 130 is preferably in the range of $1.0\times10^{8}$ to $1.0\times10^{13}\Omega$. In order to set the surface resistivity within this range, a high molecular electrically conductive agent, a surfactant, electrically conductive metal oxide particles, or the like may be added to the image receiving layer as a charge control agent, as already mentioned. In addition, in order to improve the transferability, it is preferable to add a matting agent to the image receiving layer 130 and to a coating layer other than the image receiving layer (hereinafter, the image receiving layer and the coating layer provided on the surface of the substrate other than the image receiving layer are collectively referred to as "coating layer" in some cases).

Examples of the metal oxide constituting the above-mentioned electrically conductive metal oxide particles include ZnO, TiO, $TiO_2$, $SnO_2$, $Al_2O_3$, $In_2O_3$, SiO, $SiO_2$, MgO, BaO, and $MoO_3$. Only a single metal oxide may be used, or two or more metal oxides may be used. The metal oxide preferably contains a hetero element. Examples thereof include: ZnO containing (doped with) Al, In, or the like; TiO doped with Nb, Ta, or the like; and $SnO_2$ doped with Sb, Nb, a halogen element, or the like. Among these, $SnO_2$ doped with Sb is particularly preferable because it shows little change in electrical conductivity over time and has higher stability.

A lubricative resin may be used for the matting agent. Examples of the lubricative resin include: polyolefins such as polyethylene; and fluororesins such as polyvinyl fluoride, polyvinylidene fluoride, polytetrafluoroethylene (TEFLON (registered trademark)). Specific examples thereof include low molecular weight polyolefin waxes (for example, polyethylene waxes with a molecular weight of 1000 to 5000), high density polyethylene waxes, paraffin waxes, and microcrystalline waxes.

Examples of the fluororesin include a polytetrafluoroethylene (PTFE) dispersion liquid.

The film thickness of the image receiving layer 120 provided on the surface of the substrate 110 is preferably in the range of 0.1 to 20 μm, more preferably in the range of 1.0 to 10 μm.

As a filler, inorganic particles (for example, $SiO_2$, $Al_2O_3$, talc, and kaolin) other than the inorganic particles mentioned above and plastic powder in bead form (for example, crosslinked PMMA, polycarbonate, polyethylene terephthalate, and polystyrene) may be used simultaneously.

In a preferable embodiment of the image transfer sheet for electrophotography of the present invention, a substance having antimicrobial activity (an antimicrobial agent) is contained in the image receiving layer 120 in accordance with the purpose. The material to be added is selected from the antimicrobial substances which have good dispersion stability in the composition and which are not be denatured upon irradiation with light.

The antimicrobial agent may be an organic substance. Examples thereof include thiocyanato compounds, iodopropargyl derivatives, isothiazolinone derivatives, trihalomethyl thio-compounds, quaternary ammonium salts, biguanide compounds, aldehydes, phenols, benzimidazole derivatives, pyridine oxide, carbanilide, and diphenyl ether.

Alternatively, the antimicrobial agent may be an inorganic substance. Examples thereof include zeolites, silica gels, glasses, calcium phosphates, zirconium phosphates, silicates, titanium oxide, and zinc oxide.

The volume average particle diameter of the inorganic antimicrobial agent is preferably in the range of 0.1 to 10 μm, more preferably in the range of 0.3 to 5 μm. Basically, the antimicrobial agent is preferably exposed on the surface of the image receiving layer 20. Therefore, the volume average particle diameter of the antimicrobial agent to be used is selected according to the film thickness of the outermost coating layer. When the volume average particle diameter is too large, the antimicrobial agent comes off the coating layer (powder detachment), and the film surface may be vulnerable to damage.

Further, the content of the above-mentioned antimicrobial agent in the outermost coating layer is preferably in the range of 0.05 to 5% by weight, more preferably in the range of 0.1 to 3% by weight, based on the resin constituting the coating layer.

In the present invention, the image receiving layer 120 preferably comprises an antioxidant. The antioxidant may be a commercially available antioxidant. The antioxidant to be added is selected from antioxidants which have good dispersion stability and which are not denatured upon irradiation with light. Examples thereof include phosphoric antioxidants, sulfuric antioxidants, phenolic antioxidants, and hindered amine antioxidants.

Only a single antioxidant may be used, or a mixture of two or more antioxidants may be used.

Further, in the present invention, the image receiving layer 120 preferably comprises an ultraviolet absorber. The ultraviolet absorber is selected from ultraviolet absorbers which have good dispersion stability in the composition and are not denatured upon irradiation with light. The ultraviolet absorber may be an organic substance. Examples of the organic substance include: salicylates such as phenyl salicylate, p-tert-butylphenyl salicylate, and p-octylphenyl salicylate; benzophenones such as 2,4-dihydroxy benzophenone, 2-hydroxy-4-methoxy benzophenone, 2-hydroxy-4-octyloxy benzophenone, and 2-hydroxy-4-dodecyloxy benzophenone; benzotriazoles such as 2-(2'-hydroxy-5'-methylphenyl)$_2$H-benzotriazole, 2-(2'-hydroxy-5'-tert-butylphenyl)benzotriazole, and 2-(2'-hydroxy-3'-tert-butyl-5'-methylphenyl)-5-chlorobenzotriazole; and cyano acrylates such as 2-ethylhexyl-2-cyano-3,3'-diphenyl acrylate, and ethyl-2-cyano-3,3'-diphenyl acrylate.

The ultraviolet absorber may be an inorganic substance. Examples of the inorganic substance include: oxide particles of zinc oxide or titanium oxide; and particles of a metal oxide such as iron oxide or cerium oxide.

As the ultraviolet absorber, the organic materials are particularly preferable. When the ultraviolet absorber is added, the amount of the ultraviolet absorber to be added is 0.01 to 40 parts by weight, preferably 0.1 to 25 parts by weight, based on 100 parts by weight of the compound having a reactive double bond. In order to protect the image more efficiently, it is preferable to use two or more different types of ultraviolet absorbers. In some cases, it is also preferable to add a hindered amine light stabilizer or an antioxidant.

In order to improve the transferability of the image transfer sheet in the electrophotographic apparatus, it is necessary to reduce the friction on the film surface by use of particles or the like, as mentioned above. In practical use, the coefficient of static friction on the surface of the transfer sheet is preferably 2 or less, more preferably 1 or less. The coefficient of kinetic friction on the surface of the transfer sheet is preferably in the range of 0.2 to 1, more preferably in the range of 0.3 to 0.65.

The image receiving layer 130 comprises a resin, and preferably further comprises particles. The image receiving layer 130 and coating layers other than the image receiving layer 130 are formed on the surface of the substrate 110 by the following method.

Each layer may be formed by: mixing a resin and other optional components such as particles selected in accordance with the necessity by using an organic solvent or water; subjecting the mixture to a dispersing treatment by ultrasound, a wave rotor, or an apparatus such as an attriter or a sand mill, to form a uniform dispersion liquid (a coating liquid); and applying or impregnating the coating liquid, as it is, onto the surface of the substrate 110.

The method for coating or impregnating the coating liquid may be a commonly employed method such as the blade coating method, the wire-bar coating method, the spray coating method, the immersion coating method, the bead coating method, the air knife coating method, the curtain coating method, or the roll coating method.

When the image transfer sheet has coating layers on both sides of the substrate, either surface may be coated first, or both sides may be simultaneously coated.

However, in the preparation of the coating liquid, it is preferable to use a good solvent which dissolves the surface of the substrate 110. When such a good solvent is used, the surface of the substrate 110 is dissolved and serves as a binder resin by itself, thereby providing very strong binding; as a result, it becomes easy for the particles to be held stably.

The term "a good solvent which dissolves the surface of the substrate 110" refers to a solvent which can dissolve the surface of the substrate 110 at least to such an extent that the solvent, upon contact with the surface of the substrate 110, exerts some action on the substrate 110 to dissolve the surface of the substrate 110 slightly (a slight cloud or the like is observable on the surface after removal of the solvent).

From such a viewpoint, the surface on the side of the substrate 110 on which side the coating layer is to be formed is preferably contains a PETG resin excellent in compatibility with the generally-used solvents for coating liquids. The surface is more preferably covered with such a resin.

The solvent which causes intermingling of the PETG resin contained in the surface of the substrate and the resin contained in the coating layer is not particularly limited, and may be selected from known solvents used for preparing coating liquids. Specific examples thereof include: aromatic hydrocarbons such as toluene and xylene; halogenated hydrocarbons such as methylene chloride and chlorobenzene; ketones such as methyl ethyl ketone and cyclohexanone; tetrahydrofuran; ethyl acetate; a mixture of some of these solvents; and a mixed solvent obtained by mixing any of these solvents with a poor solvent.

The drying in the formation of the coating layer on the surface of the substrate 110 may be conducted by air. As an alternative, the coating layer can be easily dried by heat. The drying method may be a commonly-used method such as a method of putting the substrate 110 having the wet coating layer in an oven, a method of passing it through an oven, or a method of bringing it into contact with a heating roller.

In fixing for image formation on the transfer sheet, the toner is fixed on the surface of the image receiving layer by simultaneous application of heat and pressure. At the same time, the toner contacts with the fixing member. Therefore, if the toner has a low viscosity, high affinity for the fixing member, or the like, a part of the toner is transferred to the fixing member and remains on the fixing member as an offset, thereby causing deterioration of the fixing member. As a result, the service life of the fixing unit is also shortened. Therefore, the transfer sheet for electrophotography has to be such that the toner image is sufficiently fixed on the transfer sheet to prevent the offset on the fixing member.

In the invention, the surface of the image receiving layer provided on the surface of the transfer sheet for electrophotography can adhere well to the toner, and the toner is sufficiently fixed on the surface of the transfer sheet at a temperature which is not higher than the temperature at which the toner is fused to become viscous.

Therefore, in the present invention, fixing of the toner image formed on the surface of the transfer sheet for electrophotography is carried out preferably in such a manner that the temperature of the surface of the transfer sheet (the surface on which the image is formed) is not higher than the melting temperature of the toner. In consideration of the melting temperature of usual toner, the surface temperature of the transfer sheet for electrophotography at the fixing is preferably 130° C. or lower, more preferably 110° C. or lower.

Even when the fixing is conducted under the above-mentioned condition, the temperature at the fixing may be within such a temperature range in which the substrate of the transfer sheet thermally deforms. In such a case, the stiffness of the transfer sheet is lowered, and the transfer sheet easily winds around the heating roll of the fixing apparatus. In such a case, it is preferable to superpose paper or the like on the transfer sheet upon conveyance so as to reinforce the stiffness of the transfer sheet in the fixing apparatus or to modify or adjust the inside of the fixing apparatus such that the film edge part contacts the guide.

In the fixing, also the non-image region of the image receiving layer contacts with the fixing member. Therefore, the image receiving layer preferably has high releasing property. The presence of the particles in the image receiving layer is preferable also from the viewpoint of securing such high releasing property.

As described above, when the constitutions, materials, and the like of the substrate and the image receiving layer are suitably selected, the image obtained by using the transfer sheet for electrophotography of the present invention is excellent in image quality (with respect to color, gloss, shielding property, and the like) required for highly design-oriented prints, free from occurrence of image defects caused by scratches, foreign matter, and the like, and sufficiently resistant to heat and light even when used outdoors. During the image formation on the image transfer sheet of the invention, the image transfer sheet is stable during repetitive image formation cycles, and occurrence of offset can be prevented even when oil-less toner is used.

(Image Recorded Medium and Method for Manufacturing Image Recorded Medium)

Next, an image recorded medium on which an image is formed by using the above-described transfer sheet for electrophotography of the present invention will be described. Herein, the term "image recorded medium" refers to a medium on which an image has been formed (recorded).

The image recorded medium of the present invention is an image recorded medium obtained by a process comprising: providing an image transfer sheet for electrophotography comprising a substrate and an image receiving layer on which a mirror image of a desired image has been formed by an electrophotographic method; adhering the surface having the mirror image to a surface of an image supporting element by heat and pressure; and, after cooling and solidification of the image forming material, peeling the substrate off the image receiving layer. As a result, the image forming material is transferred to the image supporting element. The image information is recorded in this way. The image transfer sheet for electrophotography is the above-described image transfer sheet for electrophotography of the present invention.

The image supporting element may be a plastic sheet. At least the side of the image supporting element to which side an image is to be transferred may be formed by a material comprising a vinyl chloride resin, a polycarbonate resin, or a copolymer including ethylene glycol, terephthalic acid, or 1,4-cyclohexanedimethanol as a copolymer component. The image recorded medium may comprise an information chip capable of recording and reproducing information electrically, magnetically, optically, or by a combination thereof. The chip may be an IC chip. The information may be variable information. The variable information may be personal information. In the image transfer sheet, image receiving layers may be provided on both surfaces of the substrate. Further, in an embodiment, both surfaces of the image supporting element are provided with images by using the image transfer sheets.

The image recorded medium may be (1) an image recorded medium such as an image sheet or an image panel. The image recorded medium of this type is obtained by a process comprising transferring the image on the image forming material transfer sheet for electrophotography of the present invention to the image supporting element by thermocompression bonding. Prior to the transfer, a toner image according to the information has been formed on the surface of the image forming material transfer sheet. As an alternative, the image recorded medium may be (2) an image recorded medium such as an information recording medium. The image recorded medium of this type stores predetermined information and can communicate with an external device in a contact or non-contact manner. The image recorded medium may contain such an information chip(s) that the information can be read by using at least one of electric system, magnetic system, and optical system. The information chip(s) may be disposed in at least one location in the image supporting element. Examples of the image recorded medium of this type include an IC card, a magnetic card, an optical card, and a card which is a combination thereof.

In the image recorded medium as mentioned in the above item (1), the toner image is not particularly limited, and may be such a toner image that a part or the whole of the toner image serves as information with some identification function, such as a toner image containing image information or textual information. In addition, the information contained in the toner image does not have to be identifiable visually, and may be identified mechanically.

In the image recorded medium (information recording medium) as mentioned in the above item (2), the information chip is not particularly limited, provided that the information chip stores information having some identification function and that the information is readable by using at least one selected from an electric system, a magnetic system, and an optical system. The information chip may be of read-only type. As an alternative, the information chip may be an information chip on which information can be read and written (including "rewriting"), in accordance with the necessity. Specific examples of such an information chip include an IC chip (a semiconductor circuit).

When the above-mentioned information chip is used as an information source of the image recorded medium, it is not necessary for the entire toner image or a part of the toner image to have any information having identification function.

The information held by the toner image or the information chip is not particularly limited, provided that the information is identifiable. The information may contain variable information. The term "variable information" refers to such information field that the specific information recorded on each image recorded medium is different when a plurality of image recorded media are manufactured on the same specifications or standard.

For example, when the toner image contains variable information, the part of the toner image corresponding to the variable information may vary from one image recorded medium to another.

Further, the variable information may contain personal information. In this case, the image recorded medium (the information recording medium) of the present invention is applicable to cash cards, employee identification cards, student identification cards, individual membership cards, resident identification cards, various types of driver's licenses, various types of qualification certificates, and the like. When the image recorded medium is used for such applications, examples of the personal information include a facial photograph, image information for identity verification, the name, the address, the date of birth, and a combination thereof.

The image recorded medium of the present invention is manufactured by a process comprising:

electrophotographically forming a mirror image of a desired image made of an image forming material on the surface of the image transfer sheet for electrophotography (the transfer sheet for electrophotography of the present invention) which surface is on the side having thereon the image receiving layer;

superposing the transfer sheet for electrophotography on an image supporting element such that a surface of the image supporting element and the fixed mirror image contact each other to form a stacked assembly;

subjecting the stacked assembly to thermocompression bonding; and after cooling and solidification of the image forming material, peeling the substrate of the transfer sheet off the image receiving layer so as to transfer the image forming material to the image supporting element, thereby recording the image.

In an embodiment, images are transferred from image transfer sheets to both sides of the image supporting element, in a manner similar to that described above. In this embodiment, after image formation on the transfer sheets, the two image transfer sheets are disposed on both surfaces of an image supporting element such that the image supporting element is sandwiched between the image receiving layers of the image transfer sheets.

In the transfer sheet, image receiving layers may be provided on both surfaces of the substrate.

In an embodiment, two image recorded media is manufactured from a single transfer sheet for electrophotography, by a process comprising:

electrophotographically forming mirror images of desired images made of an image forming material on both surfaces of the image transfer sheet for electrophotography (the transfer sheet for electrophotography of the present invention) having image receiving layers on both sides;

superposing two image supporting elements on the transfer sheet for electrophotography such that the image transfer sheet having the images on both sides is sandwiched between the two image supporting elements to form a stacked assembly;

subjecting the stacked assembly to thermocompression bonding; and after cooling and solidification of the image forming material, peeling the image receiving layers off the substrate of the transfer sheet so as to transfer the image forming material to the image supporting elements, thereby recording the images.

In order to form an image on the transfer sheet electrophotographically, the surface of the photoreceptor for electrophotography (an image carrier) is first uniformly provided with electric charge to be electrically charged, and then the surface is exposed to light based on the image information to form an electrostatic latent image corresponding to the light exposure. Then, the toner, which is an image forming material, is supplied from a developing unit to the electrostatic latent image on the surface of the photoreceptor, whereby the electrostatic latent image is developed with the toner and visualized (a toner image is formed). Then, the formed toner image is transferred to the surface of the transfer sheet which surface is on the side having the image receiving layer thereon. Finally the toner image is fixed on the surface of the image receiving layer by heat, pressure, and the like, and the transfer sheet is discharged from the electrophotographic apparatus.

When the transfer sheet for electrophotography of the present invention is used, the image formation surface (the surface on the side on which the image receiving layer is provided) is superposed on an image supporting element containing an IC chip or the like and the image is transferred. Therefore, the image formed on the image receiving layer of the transfer sheet has to be a reverse image (a mirror image). Accordingly, when an electrostatic latent image is formed on the surface of the photoreceptor, the image information used for exposure of the surface of the photoreceptor is preferably information of a mirror image of a desired image.

The image supporting element to be used in the present invention is made of a metal, a plastic, a ceramic, or the like, and is preferably in the form of a sheet.

The image supporting element to be used in the present invention is preferably a plastic sheet, and is preferably opaque. When an opaque image supporting element is used for forming an image recorded medium, the image formed thereon can be easily viewable. A whitened plastic sheet is a representative example of the image supporting element.

The resin for the above-mentioned plastic sheet may be any resin described above as an example of the resin used for the substrate of the image forming material transfer sheet for electrophotography. The plastic sheet is preferably a polyacetate film, a cellulose triacetate film, a nylon film, a polyester film, a polycarbonate film, a polystyrene film, a polyphenylene sulfide film, a polypropylene film, a polyimide film, cellophane, or an ABS (acrylonitrile-butadiene-styrene) resin film.

Among the above-mentioned various types of plastic films, a polyester film is preferable. The polyester film is preferably a film called PETG. The PETG film is obtained by substituting approximately half of the ethylene glycol component in the raw material of PET (polyethylene terephthalate formed from ethylene glycol and terephthalic acid) with 1,4-cyclohexane methanol component and then conducting copolymerization. Also preferable are polyester films obtained by incorporating polycarbonate to PETG to form an alloy, an amorphous polyester called A-PET, which is a PET which has not been biaxially stretched, and the like.

In a preferable embodiment, at least the surface of the image supporting element to which surface an image is to be transferred contain PETG. When the surface contains PETG, the transferred image forming material (toner) can be almost completely embedded in the surface of the image supporting element. As a result, shape of the surface of the final image recorded medium can be the same as the shape of the surface of the release layer of the transfer sheet for electrophotography.

In the present invention, the image supporting element is preferably free of chlorine, as mentioned above. Accordingly, the following materials are also preferable: sheets obtained by adding a hot-melt adhesive, such as polyester or EVA, to the polystyrene resin sheet, ABS resin sheet, AS (acrylonitrile-styrene) resin sheet, PET sheet, or polyolefin resin sheet such as polyethylene or polypropylene.

As a method for whitening the plastic, a method may be employed in which a white pigment is mixed in the film. The white pigment may be, for example: particles of a metal oxide such as silicon oxide, titanium oxide, or calcium oxide; an organic white pigment; or polymer particles. It is also possible to subject the surface of the plastic sheet to sandblasting, embossing, or the like, thereby providing the surface of the plastic sheet with irregularities. The irregularities cause scattering of light, thereby whitening the plastic sheet.

As the image supporting element to be used in the present invention, it is preferable to use a plastic sheet having a thickness of 75 to 1000 μm, and it is more preferable to use a PETG sheet having a thickness of 100 to 750 μm.

In the present invention, when the final image recorded medium is used as an IC card or the like, an image supporting element which has a semiconductor circuit inside or on the surface thereof can be used as the image supporting element.

The method for incorporating a semiconductor circuit in the image supporting element may be a method of interposing a sheet called an inlet having a semiconductor circuit fixed thereon between sheet materials for constituting the image supporting element, and then conducting hot press to integrate them by thermal fusion bonding. It is also possible to use a method of directly disposing a semiconductor circuit without using the inlet sheet, and then integrating the image supporting element and the semiconductor circuit by thermal fusion bonding in the same manner as described above.

Instead of using the above-mentioned thermal fusion bonding, it is also possible to bond the sheets constituting the image supporting element to each other by using an adhesive such as hot-melt in the process for incorporating a semiconductor circuit. However, the method for manufacturing the image supporting element is not limited to the above methods, and may be, for example, any method for incorporating a semiconductor circuit into an IC card.

Further, it is also possible to dispose the semiconductor circuit such that the semiconductor circuit is exposed on the surface of the image supporting element, rather than inside the image supporting element, as long as the image supporting element is practically usable as an image recorded medium.

When the image recorded medium of the present invention is used as a magnetic card or the like, an antenna, a magnetic stripe, an external terminal, or the like is embedded in accordance with the necessity. In addition, a magnetic stripe, a hologram, or the like may be printed on the image recorded medium, or the necessary textual information may be embossed on the image recorded medium.

The overlapping of the transfer sheet for electrophotography and the image supporting element may be carried out by aligning the transfer sheet and the image supporting element by holding them by hand, or may be carried out by sequentially delivering the transfer sheet having an image formed thereon and the image supporting element to a collation tray or the like and automatically aligning them.

In the thermocompression bonding, the compression bonding method is not particularly limited, and may be any of conventionally known various types of lamination techniques. Accordingly, any of conventionally known various lamination apparatuses may be used. Among these, it is preferable to use a heat press method in which lamination is carried out by application of heat. For example, the compression bonding may be conducted by a conventional lamination technique and lamination apparatus which pass the stacked assembly comprising the transfer sheet and the image supporting element through the pressure bonding part (nip part) between a pair of heatable nip rolls to thermally fuse the stacked assembly to some degree, thereby performing fusion bonding.

The image formed on the image transfer sheet for electrohphotography to be used for the thermocompression bonding may be an unfixed image. In this case, the color of the toner is exhibited well when the temperature of thermocompression bonding is set at a temperature which is slightly higher than the temperature in the case where the image has already undergone the fixing.

After the stacked assembly is subjected to thermocompression-bonding and then the image forming material cools to solidify, the substrate of the image transfer sheet is peeled off the image receiving layer, so that the image forming material is transferred to the image supporting element. In this way, the image is recorded to form an image recorded medium of the present invention.

The temperature of the stacked assembly immediately before peeling is specifically a temperature which equal to or lower than the softening point at which the toner solidifies sufficiently, which may be, for example, equal to or lower than the glass transition temperature of the image forming material. The temperature of the stacked assembly immediately before peeling is preferably in the range of from room temperature to 30° C. The condition in which the substrate of the transfer sheet is peeled off the image receiving layer is not particularly limited. In a preferable embodiment, the end of the transfer sheet is gripped and the substrate is gradually peeled off the image receiving layer. When the substrate of an image transfer sheet having a release layer between the substrate and the image receiving layer is peeled off, the expression "the substrate is peeled off" refers to a process in which the release layer having the substrate thereon is peeled off. Accordingly, in this specification, when the image transfer sheet has a release layer between the substrate and the image receiving layer, the expression "the substrate is peeled off the image receiving layer" refers to a process in which the release layer having the substrate thereon is peeled off the image receiving layer, and the expression "the image receiving layer is peeled off the substrate" refers to a process in which the image receiving layer is peeled off the release layer having thereon the substrate.

Figure 3A:
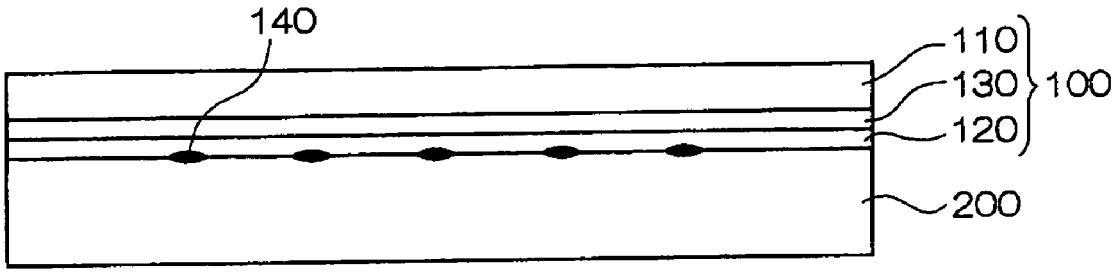
FIG. 3*a* and FIG. 3*b* show cross-sectional views illustrating the state of the laminate before adhesion by heat and pressure and the state of the image recorded medium after adhesion by heat and pressure.
Figure 3B:
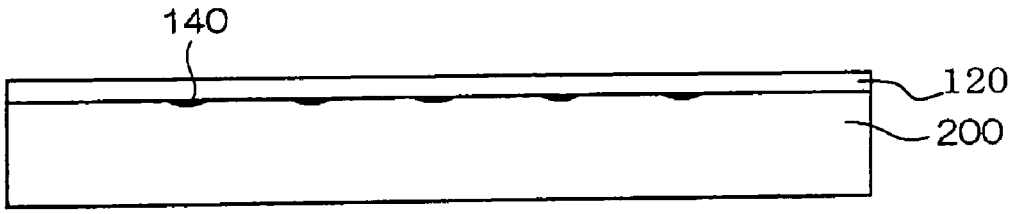

Next, specific examples of the information recording medium as mentioned above will be described with reference to the drawings. FIG. 3*a* and FIG. 3*b* show cross-sectional views illustrating the state of the image recorded medium of the present invention before thermocompression bonding in its production process, and an example of the image recorded medium after thermocompression bonding and peeling-off. In FIGS. 3*a* and 3*b*, the reference character 100 indicates a transfer sheet for electrophotography, and the reference character 200 indicates an image supporting element (an image recorded medium).

FIG. 3*a* illustrates a stacked assembly which has been formed by superposing the transfer sheet 100 for electrophotography on an image supporting element 200 (a PETG sheet) to which the image is to be transferred. Before thermocompression bonding, an image forming material (toner) 140 is present on the image receiving layer 120 side of the of the transfer sheet, or on the interface between the image receiving layer 120 and the image supporting element 200.

On the other hand, as shown in FIG. 3*b*, the image forming material 140 after thermocompression bonding and peeling-off is completely embedded in the surface of the image supporting element 200 and in the image receiving layer 120. Therefore, the surface of the image supporting element 200 is almost flush with the area on which the image forming material 140 is present. Accordingly, the obtained image recorded medium has the same feeling as an image recorded medium obtained by direct printing thereon. Further, the image forming material 140 does not come off easily.

The image recorded medium obtained by peeling can be used as an image recorded medium of the present invention, as it is. However, when a plurality of separate images are formed on the transfer sheet for electrophotography, the obtained image recorded medium may be cut for the respective images, to form a plurality of image recorded media of a predetermined size.

(Image Recorded Medium Manufacturing Apparatus)

Next, an image recorded medium manufacturing apparatus of the present invention will be described.

The image recorded medium manufacturing apparatus of the present invention uses the transfer sheet for electrophotography, and employs the image recorded medium manufacturing method of the present invention. The apparatus comprises a transfer sheet storing part, an image forming part, an image supporting element storing part, a positioning part, a thermocompression bonding part, and a peeling part. The transfer sheet storing part contains transfer sheets for electrophotography having an image receiving layer on at least one side thereof. The image forming part electrophotographically forms an image made of an image forming material as a mirror image on the image receiving layer side of the transfer sheet for electrophotography. The image supporting element storing part contains image supporting elements. The positioning part forms a stacked assembly by superposing the transfer sheet for electrophotography on at least one side of the image supporting element such that the side of the image supporting element contacts the transfer sheet surface having the image thereon. The thermocompression bonding part applies heat and pressure to the stacked assembly to conduct thermocompression-bonding. The peeling part peels the substrate of the transfer sheet off the image receiving layer after cooling and solidification of the image forming material, to transfer the image forming material to the image supporting element, thereby recording the image.

Figure 4:
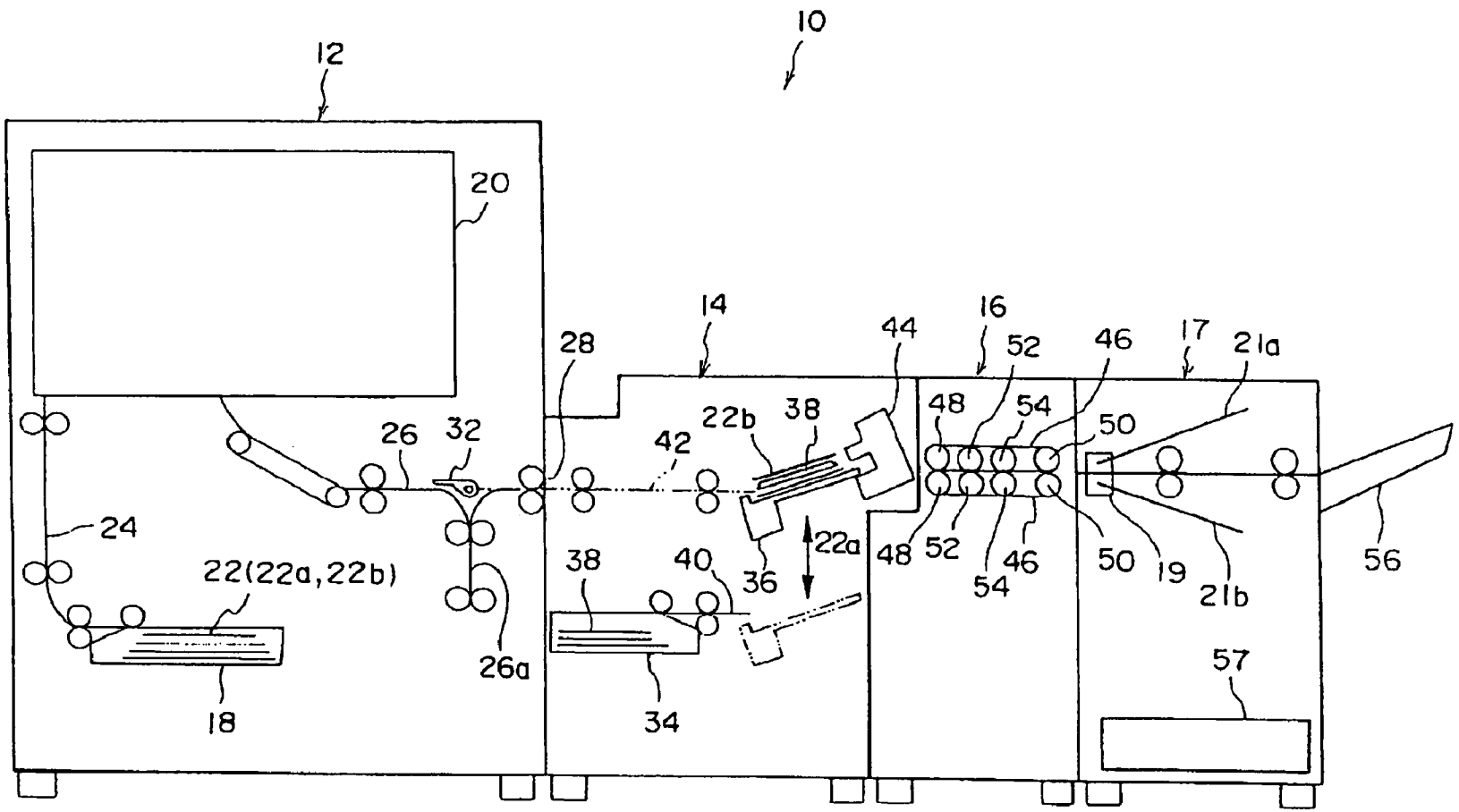
FIG. 4 is a schematic drawing illustrating an exemplary structure of the image recording medium manufacturing apparatus of the present invention.

FIG. 4 is a schematic configuration drawing illustrating an image recorded medium manufacturing apparatus of the present invention.

The image recorded medium manufacturing apparatus 10 shown in FIG. 4 comprises an image forming apparatus 12, a collation apparatus 14 (positioning part), a lamination apparatus 16 (thermocompression bonding part), and a peeling apparatus 17 (peeling part).

The image forming apparatus 12 comprises, for example, a transfer sheet stacker 18 (transfer sheet storing part), an image forming part 20, a conveyance path 24 through which a transfer sheet 22 is conveyed from the transfer sheet stacker 18 to the image forming part 20, and a conveyance path 26 through which the transfer sheet 22 is conveyed from the image forming part 20 to a discharge opening 28. Description of the other components is omitted.

The transfer sheet stacker 18 stores transfer sheets 22, and comprises a pick-up roller and paper feed rollers which are similar to pick-up rollers and paper feed rollers provided in general paper feed apparatuses. The paper feed rollers and the like are rotated at a prescribed timing so as to convey the transfer sheet 22 to the image forming part 20.

The image forming part 20 comprises an apparatus of a known electrophotographic apparatus. The apparatus comprises: a latent image carrier for forming a latent image; a developing unit which uses a developer containing at least toner for developing the latent image to give a toner image; a transfer unit for transferring the developed toner image to the transfer sheet 22; and a fixing unit which heats and presses the toner image transferred to the transfer sheet 22 to fix the image.

The conveyance path 24, 26 comprises: a plurality of roller pairs including a drive roller pair, and a guide (not shown). The conveyance path 26 is provided with a reversing path 26*a* for reversing the direction of conveyance of the transfer sheet 22. In the vicinity of the point of bifurcation between the conveyance path 26 and the reversing path 26*a*, a cam 32 for changing the guiding direction of the transfer sheet 22 is provided. When the transfer sheet 22 enters the reversing path 26*a* and then returns to the conveyance path 26, the conveyance direction of the transfer sheet 22 is reversed, and the transfer sheet 22 is turned upside down.

The collation apparatus 14 comprises a plastic sheet (image supporting element) stacker 34, a collation tray 36 (positioning part), a conveyance path 40 through which a plastic sheet 38 (image supporting element) is conveyed from the plastic sheet (image supporting element) stacker 34 to the collation tray 36, and a conveyance path 42 through which the transfer sheet 22 delivered from the discharge opening 28 of the image forming apparatus 12 is supplied to the collation tray 36.

The discharge part of the conveyance path 40 for supplying the plastic sheet 38 to the collation tray 36, and the discharge part of the conveyance path 42 for supplying the transfer sheet 22 to the collation tray 36, are provided in parallel to each other and separated in the vertical direction.

The conveyance paths 40 and 42 each may comprise a smooth planar member and conveying rollers for conveying the transfer sheet 22 on the surface of the smooth planer member, or may comprise a rotating belt-like conveying element. And, the conveying rolls or the belt are rotated to convey the transfer sheet 22 or the plastic sheet 38 to the collation tray 36 in synchronization with the discharge of the transfer sheet 22 from the image forming apparatus 12 or with the discharge of the plastic sheet 38.

The plastic sheet stacker 34 (the image supporting element storing part) stores plastic sheets 38, and comprises a pick-up roller and paper feed rollers which are similar to pick-up rollers and paper feed rollers provided in general paper feed apparatuses. The paper feed rolls or the like are rotated to convey the plastic sheet to the collation tray 36 immediately after the collation tray 36 is moved to the discharge opening of the plastic sheet stacker 34.

In order that the plastic sheet 38 and the transfer sheet 22 are supplied respectively from the discharge part of the conveyance path 40 and the discharge part of the conveyance path 42, the collation tray 36 may, for example, have a configuration in which: a part of the end of the collation tray 36 is connected to the outer surface of a belt which is installed vertically (from top to bottom in the drawing) and the collation tray 36 is vertically moved together with the rotating movement of the belt. The vertical moving system is not limited to this example, and may be a motor driving system or any other known system. A positioning device (not shown) is also provided to the collation tray 36 and the positioning device aligns the edges of the plastic sheet 38 and the transfer sheet 22 which have been overlapped.

The collation tray 36 is provided with a temporarily fastening apparatus 44 which temporarily fastens two transfer sheets 22 separated by a plastic sheet 38. This temporarily fastening apparatus, for example, comprises a pair of protrusions made of metal which can be heated by a heater, and the two transfer sheets 22 separated by a plastic sheet 38 are temporarily fastened to each other through thermal fusion of a vicinity of the edge of the stacked sheets when the vicinity of the edge of the stacked sheets is held by the heated pair of protrusions.

The temporarily fastening method which employs thermal fusing is not limited to the method using a pair of hot protrusions, and may be any other existing method, such as a method of penetrating a heated needle-like member through the sheets in the vertical direction or a method of holding the sheets with a member loaded with an ultrasonic vibrator to perform fusing by the heat generated by the ultrasonic vibration. Further, the method for temporarily fastening the sheets may be a method of mechanically restraining the mutual movement without using heat, such as a method of using a stapler needle or the like to fasten the sheets, or a method of using a gripper which is movable with the sheets along the conveyance path.

When the temporarily fastening apparatus 44 is provided on the conveyance path for conveying the stacked assembly from the collation tray 36 to the lamination apparatus 16, the temporarily fastening apparatus 44 has to be constructed such that the temporarily fastening apparatus 44 is disposed at the end of the collation tray 36 only when temporary fastening is carried out, and that the temporarily fastening apparatus 44 is capable of being withdrawn from the conveyance path at any other time.

The lamination apparatus 16 may employ, for example, a belt nip system which uses a pair of belts 46. The respective belts 46 are tightened by heat-press rolls 48 and tension rolls 50. Reference characters 52 and 54 represent rolls.

The thermocompression bonding method for use in the lamination apparatus 16 is not particularly limited, and the thermocompression bonding may use any of various conventionally-known lamination techniques and lamination apparatuses. For example, the conventional lamination technique and lamination apparatus may be used in which the stacked assembly is passed through the nip part formed by a pair of nip rolls or the like so as to thermally fuse the stacked assembly to some degree and so as to conduct thermal fusion bonding. The compression bonding may be conducted also by a heat press technique and a heat press apparatus.

The peeling apparatus 17 comprises, for example, an air injection nozzle 19 and guides 21*a* and 21*b*. A discharge tray 56 may be provided on the downstream side of the plastic sheet conveyance path.

First, in the image forming apparatus 12, a first transfer sheet 22*a* (a transfer sheets 22) to be pressure-bonded to the back side (the lower side in the drawing) of the plastic sheet 38 is supplied from the transfer sheet stacker 18 to the image forming part 20 through the conveyance path 24. Then, a predetermined toner image is transferred to and then fixed on the front side (the upper side in the drawing) of the first transfer sheet 22*a* electrophotographically to form a fixed image (the image formation process). Since the fixed image is formed on the front side of the first transfer sheet 22*a*, the first transfer sheet 22*a* is conveyed directly to the discharge opening 28 through the conveyance path 26, and fed to the collation apparatus 14.

Then, in the collation apparatus 14, the first transfer sheet 22*a* is supplied to the collation tray 36 through the conveyance path 42 of the collation apparatus 14. Here, the first transfer sheet 22*a* which has left the discharge part of the conveyance path 42 is supplied to the collation tray 36 by its own weight with the image surface of the first transfer sheet 22*a* facing upward.

Then, the collation tray 36 is lowered to near the discharge part of the conveyance path 40, and the plastic sheet 38 is supplied from the plastic sheet stacker 34 to the collation tray 36 through the conveyance path 40. Here, the plastic sheet 38 which has left the discharge part of the conveyance path 40 is supplied to the collation tray 36 by its own weight to be superposed on the first transfer sheet 22*a*.

Then, in the image forming apparatus 12, a second transfer sheet 22*b* to be pressure-bonded to the front side (the top side in the drawing) of the plastic sheet 38 is supplied from the transfer sheet stacker 18 to the image forming part 20 through the conveyance path 24. Subsequently, a predetermined toner image is transferred to and then fixed on the front side (the top side in the drawing) of the second transfer sheet 22*b* electrophotographically to form a fixed image (the image formation process). Because the fixed image is formed on the front side of the second transfer sheet 22*b*, the second transfer sheet 22*b* is passed through the conveyance path 26 to enter the reversing path 26*a* once, and then the second transfer sheet 22*b* is brought back to the conveyance path 26 to be conveyed to the discharge opening 28, then further conveyed to the collation apparatus 14.

At this time, the cam 32 is driven such that the tip thereof is put upon the conveyance path 26 in the vicinity of the bifurcation point between the conveyance path 26 and the reversing path 26*a*, and the conveyance direction of the second transfer sheet 22*b* is changed when the second transfer sheet 22*b* reaches the tip of the cam 32, so that the second transfer sheet 22*b* is guided and conveyed to the reversing path 26*a*. After the second transfer sheet 22*b* reaches the reversing path 26*a*, the driving rollers (not shown) are rotated in the inverse direction to convey the second transfer sheet 22*b* in the inverse direction through the reversing path 26*a*, so that the second transfer sheet 22*b* is brought back to the conveyance path 26. Therefore, the second transfer sheet 22*b* which has been brought back to the conveyance path 26 has the opposite orientation to that of the second transfer sheet 22*b* before entering the reversing path 26*a*, with respect to the leading end and the trailing end and with respect to the upper side and the lower side. Thus, the image surface of the second transfer sheet 22*b* which has returned from the reversing path 26*a* faces downward (to the lower side in the drawing).

Then, in the collation apparatus 14, the second transfer sheet 22*b* is supplied to the collation tray 36 through the conveyance path 42 in the collation apparatus 14. Here, the second transfer sheet 22*b* which has left the discharge part of the conveyance path 42 is supplied to the collation tray 36 by its own weight to be superposed on the plastic sheet 38 with the image surface of the second transfer sheet 22*b* facing downward.

Thus, to the collation tray 36, the first transfer sheet 22*a* having the image surface facing upward, the plastic sheet 38, and the second transfer sheet 22*b* having the image surface facing downward are supplied in this order and superposed one upon another (the positioning process). In this stacked assembly, the image surface of the first transfer sheet 22*a* and the image surface of the second transfer sheet 22*b* contact the opposite surfaces of the plastic sheet 38, respectively.

Then, the edges of the first transfer sheet 22*a*, the plastic sheet 38, and the second transfer sheet 22*b* on the collation tray 36 are aligned by the positioning system (not shown), and then the edges of the stacked sheets are temporarily fastened by the temporarily fastening apparatus 44. Thereafter, the stacked sheets are fed to the lamination apparatus 16. The transfer sheet 22 and the plastic sheet 38 have the same size, and thus positioning is carried out by aligning the edges of the stacked sheets.

Then, in the lamination apparatus 16, the stacked assembly composed of the first transfer sheet 22*a*, the plastic sheet 38, and the second transfer sheet 22*b* are passed through the nip between the pair of belts 46 to be subjected to thermocompression bonding, and the plastic sheet 38 is thermocompression-bonded to the first transfer sheet 22*a* and the second transfer sheet 22*b* (the thermocompression bonding process).

The thermocompression-bonded stacked assembly is then fed to the peeling apparatus 17. The plastic sheet 38, for example, has a notch at the front right edge, and in that portion, the first transfer sheet 22*a* and the second transfer sheet 22*b* face each other with a certain clearance between them, without being adhered to the plastic sheet 38. When the leading end of the stacked assembly comes near the air injection nozzle 19, compressed air is injected from the nozzle. The edges of the first transfer sheet 22*a* and the second transfer sheet 22*b* are lifted from the plastic sheet 38, the ends of the guides 21*a* and 21*b* are inserted between the first transfer sheet 22*a* and the plastic sheet 38, and between the second transfer sheet 22*b* and the plastic sheet 38. Further, as the stacked assembly is conveyed, the two transfer sheets are conveyed in such directions along the guides 21*a* and 21*b* that the two transfer sheets are peeled off the plastic sheet 38. As a result, the transfer sheets are peeled off the plastic sheet 38.

The plastic sheet 38 is discharged to the discharge tray 56 to give a recorded plastic sheet. When a plurality of individual images are formed on the plastic sheet, the plastic sheet is cut out for the respective images to form plastic sheets having a predetermined size.

The first transfer sheet 22*a* and the second transfer sheet 22*b* are thereafter passed through paths (not shown) to be discharged to a transfer sheet discharge tray 57. The discharged transfer sheet may be returned to the transfer sheet stacker to be used for image recording again.

As described above, in the image recorded medium manufacturing apparatus of the present invention, an image is formed on one side of each of two transfer sheets 22 electrophotographically, and the image surfaces of these two transfer sheets 22 are allowed to face each other while separated by the plastic sheet 38. Then, thermocompression bonding is conducted, and then the transfer sheets are peeled off. Accordingly, an image having a high resolution can be printed on a plastic sheet with a high productivity by using an apparatus as an image forming device which can be obtained by minor modification of a conventional electrophotographic apparatus.

In addition, in the middle of the conveyance path 26 for conveying the transfer sheet 22 from the image forming part 20 to the discharge opening 28 in the image forming apparatus 12, the reversing path 26*a* is provided. The first transfer sheet 22*a*, which is to be supplied to the lower side of the collation tray 36, is conveyed without entering the reversing path 26*a*, and the second transfer sheet 22*b*, which is to be supplied to the upper side, is allowed to enter the reversing path 26*a* during conveyance and the front and back thereof is reversed. By selectively reversing the front and back of the transfer sheet 22 in this manner, positioning can be performed continuously, whereby printing on the plastic sheet can be conducted more efficiently.

EXAMPLES

Hereinafter, the present invention will be more specifically described by using Examples. However, the present invention is by no means limited to the following Examples. In the following description, the term "part" used in the Examples and Comparative Examples means "part by weight".

Example 1

A transfer sheet for electrophotography (transfer sheet 1) is manufactured as follows. Hereinafter, the manufacturing method will be described for each process.

(Preparation of Release Layer Coating Liquid 1)

20 parts of a silicone hardcoat agent containing an organic silane condensation product, melamine resin, and alkyd resin (manufactured by GE Toshiba Silicone; SHC900, solid content 30% by weight) is added to 30 parts of a solution obtained by mixing cyclohexanone and methyl ethyl ketone in a weight ratio of 10 to 90, and the mixture is thoroughly stirred to prepare a release layer coating liquid 1.

(Preparation of Image Receiving Layer Coating Liquid 1)

20 parts of a polyester resin (manufactured by TOYOBO Co., Ltd.; VYLON 200), 1 part of cross-linked acrylic particles (manufactured by Soken Chemical & Engineering Co., Ltd.; MX-500, volume average particle diameter 5 μm), and 0.6 part of a charge control agent (manufactured by NOF CORPORATION; Elegan 264 WAX) are added to 80 parts of a solution obtained by mixing cyclohexanone and methyl ethyl ketone in a weight ratio of 10 to 90, and the mixture is thoroughly stirred to prepare an image receiving layer coating liquid 1.

(Preparation of Resistance Adjusting Layer Coating Liquid 1)

20 parts of a polyester resin (manufactured by Soken Chemical & Engineering Co., Ltd.; FORET 4M, solid content 30% by weight), 0.6 part of cross-linked acrylic particles (manufactured by Soken Chemical & Engineering Co., Ltd.; MX-300, volume average particle diameter 3 μm), and 0.3 part of a charge control agent (manufactured by NOF CORPORATION; ELEGAN 264 WAX) are added to 80 parts of a solution obtained by mixing cyclohexanone and methyl ethyl ketone in a weight ratio of 10 to 90, and the mixture is thoroughly stirred to prepare a resistance adjusting layer coating liquid 1.

(Manufacture of Transfer Sheet for Electrophotography)

A PET film (manufactured by Toray Industries, Inc.; LUMIRROR 100T60, thickness 100 μm) is used as a substrate, and to one side of this substrate, the resistance adjusting layer coating liquid 1 is applied by using a wire bar, and dried at 120° C. for 30 sec to form a resistance adjusting layer with a film thickness of 0.2 μm on the back side of the substrate. To the other side (an untreated surface) of this substrate, the release layer coating liquid 1 is applied by using a wire bar in the same manner, and dried at 120° C. for 30 sec to form a release layer with a film thickness of 1 μm. To this release layer, the image receiving layer coating liquid 1 is applied by using a wire bar, and dried at 120° C. for 60 sec to form an image receiving layer with a film thickness of 2 μm. Thereafter, the substrate is cut to A4 size (210 mm×297 mm) to give a transfer sheet 1. The surface resistivity of the resistance adjusting layer of this transfer sheet 1 is $2\times10^{9}\Omega$, and that of the image receiving layer is $3.5\times10^{9}\Omega$.

(Performance Evaluation of Image Forming Material Transfer Sheet for Electrophotography)

On the image receiving layer surface of the transfer sheet 1 (having no image thereon), a color mirror image of an image including a facial photograph, a name, numerical characters of 1 to 5 points in size, and a solid image is formed by using an image formation apparatus (a color copying machine DOCUCOLOR 1255CP manufactured by Fuji Xerox Co., Ltd.).

In formation of this image, the traveling performance of the transfer sheet 1 in the image formation apparatus during conveyance is evaluated as follows:

—Traveling Performance Evaluation—

The traveling performance of the manufactured transfer sheet 1 in the color copying machine is evaluated by: setting 30 pieces of the transfer sheet 1 at the manual feed tray of the color copying machine DOCUCOLOR 1255CP, and counting the number of occurrences of jam and double feeding during continuous printing operation on the 30 pieces. The evaluation criteria are as follows:

A: the number of occurrences is 0;

B: the number of occurrences is 1; and

C: the number of occurrences is 2 or more.

The results are shown in Table 1.

—Evaluation of Adhesion Strength Between Release Layer and Image Receiving Layer—

To the image receiving layer surface of the manufactured transfer sheet 1, an acrylic type adhesive tape with a width of 25 mm (manufactured by NITTO DENKO CORPORATION; Nitto Polyester Tape 31B) is attached under a line pressure of 500 g/cm to a length of 200 mm. Then, the image receiving layer is peeled off the release layer at a speed of 10 mm/sec at a peeling-off angle of 180 deg., and the force required for peeling is measured. The result is 1.7 g/25 mm.

—Evaluation of Image Retransferability—

The medium to which the image is to be transferred is an A4 white sheet (manufactured by Mitsubishi Plastics, Inc.; DIACLEAR W2012, thickness 500 μm) having surface made of PETG and core made of A-PET. The transfer sheet 1 having the image described above is superposed on the white sheet such that the image surface contacts the white sheet. A laminator (manufactured by FUJIPLA Inc.; LAMIPACKER LPD3206 City) is used to adhere the transfer film 1 to the white sheet under the conditions of 160° C. and a feed rate of 0.3 m/min (5 mm/s). Thereafter, the image transfer sheet is peeled off to transfer (retransfer) the image and the image receiving layer to the white sheet.

"A" indicates that the image receiving layer is completely transferred to the white sheet together with the image. "B" indicates that the image receiving layer is partially left on the substrate. "C" indicates other cases.

(Manufacture of Image Recorded Medium (Card 1))

An A4 white sheet (manufactured by Mitsubishi Plastics, Inc.; DIACLEAR W2012, thickness 600 μm) having front and rear surfaces made of PETG and core made of A-PET, is used as an image supporting element. The image transfer sheets 1 having the fixed images thereon are superposed on the front and rear surfaces of the image supporting element, respectively such that the image surfaces contact the A4-size white sheet. A laminator (manufactured by FUJIPLA Inc.; LAMIPACKER LPD3206 CITY) is used to perform lamination under the conditions of 160° C. and a feed rate of 0.3 m/min (5 mm/s). After the transfer sheets 1 are cooled to room temperature, the transfer sheets 1 are peeled off the white sheet to form a card 1 (an image recorded medium 1) having the transferred images including facial photographs on the white sheet.

(Evaluation of Image Recorded Medium)

The card 1 is evaluated as described below.

—Evaluation of Fixability of Image—

Evaluation of the fixability of a toner image is carried out by attaching a commercially available adhesive cellophane tape with a width of 18-mm (manufactured by NICHIBAN CO., LTD; Cellophane Tape) to the transferred image part on the front surface of the card 1 at a line pressure of 700 g/cm. Then, the tape is peeled off at a speed of 10 mm/sec and the degree of peeling-off of the toner image is evaluated.

"A" indicates that the card 1 is not damaged at all, and "B" indicates that the image on the card 1 is peeled off or damaged even if only slightly. The results are shown in Table 1.

—Image Density and Quality Evaluation—

The evaluation of the image density is conducted by measuring the density of the solid image part by using the X-Rite 967 Densitometer (manufactured by X-Rite). "A" indicates that the image density is 1.5 or higher; "B" indicates that the image density is 1.3 or higher but lower than 1.5; and "C" indicates that the image density is lower than 1.3.

The image quality is evaluated based on whether the printed thin line textual image is precisely transferred (print reproducibility). After 1 to 5 point numerical characters are printed and transferred as an image, the minimum point size of the recognizable character is determined to evaluate the image quality. Specifically, "A" indicates that the minimum point size is 1 or 2 point, "B" indicates that the minimum point size is 3 point, "C" indicates that the minimum point size is 4 point, and "D" indicates that the minimum point size is 5 point or larger. The results are shown in Table 1.

—Evaluation of Surface Friction Wear Resistance—

Assuming that the manufactured card is used as a magnetic card, the card is passed through a magnetic card reader (manufactured by Elite; MR321/PS) 500 times continuously, and the scratches and wear which occur during this test are visually observed. "A" indicates that no change occurs, "B" indicates that only minute scratches are observable, "C" indicates that a significant scratch streak is observable, and "D" indicates that the image receiving layer is peeled off and the image is adversely affected. The results are shown in Table 1.

Comparative Example 1

Evaluation is carried out in the same manner as in Example 1, except that an unprocessed commercially available PET sheet (manufactured by Toray Industries, Inc.; T60, thickness 100 μm, surface resistivity $1\times10^{17}\Omega$) is used as the transfer sheet for electrophotography.

As a result, double feeding occurs frequently in the evaluation of the traveling performance. The fixed image does not have adequate density or image quality. Further, in manufacturing the image recorded medium, the PET sheet adheres to the white sheet (the image supporting element), and cannot be peeled off the white sheet. Therefore, the PET sheet cannot be used as a transfer sheet, and the desired image recorded medium is not obtained.

Comparative Example 2

A transfer sheet 2 for electrophotography is manufactured in the same manner as in Example 1, except that the charge control agent and the particles are respectively not added in the preparation of the back surface resistance adjusting layer coating liquid 1 and the preparation of the image receiving layer coating liquid 1. The front and back surfaces of the transfer sheet 2 for electrophotography each exhibited a surface resistivity of $7\times10^{16}\Omega$. Using this transfer sheet 2 for electrophotography, the evaluation is carried out in the same manner as in Example 1.

As a result, the adhesion strength between the release layer and the image receiving layer is found to be 1.7 g/25 mm, similarly to Example 1. However, in the evaluation of the traveling performance, sheet-to-sheet adhesion causes double feeding about 5 times. The manufactured card 2 (the image recorded medium 2) has an uneven density in the solid image, and there is a part with a density of lower than 1.3. Further, in the evaluation of the fine character reproducibility, a character as large as 5 point is reproduced sufficiently.

Comparative Example 3

As the substrate, a PET film (manufactured by Toray Industries, Inc.; LUMIRROR 100T60, thickness 100 μm) is used. To one side of this substrate, the same release layer as in Example 1 is formed in the same manner as in Example 1. To this release layer, a urethane resin film (manufactured by NIHON MATAI CO., Ltd; ELPHAN UH203) having a thickness of 20 μm is adhered by heat lamination to form an image receiving layer, so that a transfer sheet 3 for electrophotography is obtained. The transfer sheet 3 for electrophotography has a surface resistivity of $1\times10^{17}\Omega$ on the backside, and the image receiving layer has a surface resistivity of $6.5\times10^{16}\Omega$. Using this transfer sheet 3 for electrophotography, the evaluation is carried out in the same manner as in Example 1.

As a result, after the image receiving layer is formed by lamination, the sheet curls. Therefore, the traveling performance was evaluated only by manual feed of the sheets one by one rather than by using a stack of 30 sheets. The adhesion strength between the release layer and the image receiving layer is found to be 3.7 g/25 mm. The manufactured card 3 (the image recorded medium 3) has an uneven density in the solid image, and there is a part having a density of lower than 1.3. Further, in the evaluation of the fine character reproducibility, a character as large as 5 point is not sufficiently reproduced.

Example 2

Preparation of Image Receiving Layer Coating Liquid 2

20 parts of an acrylic urethane resin (manufactured by Soken Chemical & Engineering Co., Ltd.; SU-100A, solid content 50% by weight), 0.1 part of cross-linked acrylic particles (manufactured by Soken Chemical & Engineering Co., Ltd.; MX-800, volume average particle diameter 8 μm), and 2.5 parts of a charge control agent (manufactured by NOF CORPORATION; ELEGAN 264 WAX) are added to 30 parts of a solution obtained by mixing cyclohexanone and methyl ethyl ketone in a weight ratio of 10 to 90. The mixture is thoroughly stirred to prepare an image receiving layer coating liquid 2.

(Manufacture of Image Transfer Sheet (Transfer Sheet 4) for Electrophotography)

A sheet is provided in the same manner as in Example 1 which has the resistance adjusting layer on its back surface and the release layer on the other surface. To the release layer of the sheet, the image receiving layer coating liquid 2 is applied by using a wire bar in the same manner as in Example 1, and dried at 120° C. for 3 min to form a image receiving layer with a film thickness of 5 μm. Thereafter, the sheet is cut to A4 size (210 mm×297 mm) to form a transfer sheet 4. The surface resistivity of this image receiving layer is $2.3\times10^{12}\Omega$. The adhesion strength between the release layer and the image receiving layer is found to be 2.2 g/25 mm.

(Performance Evaluation of Image Transfer Sheet 4 for Electrophotography)

On the image receiving layer surface of the transfer sheet 4 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 4 during conveyance is evaluated in the same manner as in Example 1. There is no problem in conveyance as clarified in Table 1.

(Manufacture of Image Recorded Medium (Card 4))

An A4-size white sheet (manufactured by Mitsubishi Plastics, Inc.; DIAFIX, thickness 600 μm) made of PETG is used as an image supporting element. The image transfer sheets 4 having fixed images thereon are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 170° C. and a feed rate of 0.3 m/min (5 mm/s). After the transfer sheets 4 are cooled to room temperature, the transfer sheets 4 are peeled off the white sheet to form a card 4 (an image recorded medium 4) having the transferred images including facial photographs on the white sheet.

(Evaluation of Card 4 (Image Recorded Medium 4))

The card 4 is evaluated with respect to the fixability of toner image, image density, image quality, and friction wear resistance, in the same manner as in Example 1.

The results are shown in Table 1.

Example 3

Preparation of Image Receiving Layer Coating Liquid 3

40 parts of a urethane modified polyester resin (manufactured by TOYOBO Co., Ltd.; UR-4122, solid content 30% by weight), 0.6 part of cross-linked acrylic particles (manufactured by Soken Chemical & Engineering Co., Ltd.; MX-3000, volume average particle diameter 30 μm), and 0.8 part of a charge control agent (manufactured by NOF CORPORATION; ELEGAN 264 WAX) are added to 30 parts of a solution obtained by mixing cyclohexanone and methyl ethyl ketone in a weight ratio of 10 to 90. The mixture is thoroughly stirred to prepare an image receiving layer coating liquid 3.

(Manufacture of Image Transfer Sheet (Transfer Sheet 5) for Electrophotography)

As a substrate, a PET film (manufactured by PANAC CO., LTD.; PET100SG-2, thickness 101 μm) whose one side is provided with the release layer used in Example 1 is used. To the unprocessed surface (the opposite surface) of this substrate, the resistance adjusting layer coating liquid 1 is applied by using a wire bar, and dried at 120° C. for 30 sec to form a resistance adjusting layer with a film thickness of 0.2 μm on the back side of the substrate. To the release layer, the image receiving layer coating liquid 3 is applied by using a wire bar in the same manner as in Example 1, and dried at 120° C. for 5 min to form an image receiving layer with a film thickness of 25 μm. Thereafter, the substrate is cut to A4 size (210 mm×297 mm) to give a transfer sheet 5. The surface resistivity of this image receiving layer is $1.3\times10^{8}\Omega$. The adhesion strength between the release layer and the image receiving layer is found to be 4.2 g/25 mm.

(Performance Evaluation of Image Transfer Sheet 5 for Electrophotography)

On the image receiving layer surface of the transfer sheet 5 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 5 during conveyance is evaluated in the same manner as in Example 1. There is no problem in conveyance as clarified in Table 1.

(Manufacture of Image Recorded Medium (Card 5))

An A4-size white sheet (manufactured by Mitsubishi Plastics, Inc.; VINYFOIL C-4636, thickness 500 μm) made of vinyl chloride is used as the image supporting element. The image transfer sheets 5 having the fixed images thereon are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 170° C. and a feed rate of 0.3 m/min (5 mm/s). After the transfer sheets 5 are cooled to room temperature, the transfer sheets 5 are peeled off the white sheet to form a card 5 (an image recorded medium 5) having the transferred images including facial photographs on the white sheet.

(Evaluation of Card 5 (Image Recorded Medium 5))

The card 5 is evaluated in the same manner as in Example 1, with respect to the fixability of toner image, image density, image quality, and friction wear resistance.

The results are shown in Table 1.

Example 4

Preparation of Image Receiving Layer Coating Liquid 4

40 parts of a polyester resin (manufactured by Soken Chemical & Engineering Co., Ltd.; FORET FF-4M, solid content 30% by weight), 6 parts of cross-linked acrylic particles (manufactured by Soken Chemical & Engineering Co., Ltd.; MX-1500H, volume average particle diameter 15 μm), and 0.4 part of a charge control agent (manufactured by NOF CORPORATION; ELEGAN 264 WAX) are added to 30 parts of a solution obtained by mixing cyclohexanone and methyl ethyl ketone in a weight ratio of 10 to 90. The mixture is thoroughly stirred to prepare an image receiving layer coating liquid 4.

(Manufacture of Image Transfer Sheet (Transfer Sheet 6) for Electrophotography)

To the release layer, the receiving layer coating liquid 4 is applied by using a wire bar in the same manner as in Example 3, and dried at 120° C. for 2 min to form an image receiving layer with a film thickness of 10 μm. Thereafter, the substrate is cut to A4 size (210 mm×297 mm) to form a transfer sheet 6. The surface resistivity of this image receiving layer is $1.8\times10^{9}\Omega$. The adhesion strength between the release layer and the image receiving layer is found to be 4.4 g/25 mm.

(Performance Evaluation of Image Transfer Sheet 6 for Electrophotography)

On the image receiving layer surface of the above-mentioned transfer sheet 6 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 6 in conveyance is evaluated in the same manner as in Example 1. There is no problem in conveyance as clarified in Table 1.

(Manufacture of Image Recorded Medium (Card 6))

An A4-size white sheet (manufactured by Mitsubishi Plastics, Inc.; PG-WHI, thickness 600 μm) made of PETG resin is used as an image supporting element. The image transfer sheets 6 having the fixed images thereon are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 170° C. and a feed rate of 0.3 m/min (5 mm/s). After the transfer sheets 6 are cooled to room temperature, the transfer sheets 6 are peeled off the white sheet to give a card 6 (an image recorded medium 6) having the transferred images including facial photographs on the white sheet.

(Evaluation of Card 6 (Image Recorded Medium 6))

The card 6 is evaluated in the same manner as in Example 1, with respect to the fixability of toner image, image density, image quality, and friction wear resistance.

The results are shown in Table 1.

Example 5

Preparation of Image Receiving Layer Coating Liquid 5

10 parts of a polyvinyl butyral resin (manufactured by Sekisui Chemical Co., Ltd.; BM-S), 0.5 part of cross-linked acrylic particles (manufactured by Soken Chemical & Engineering Co., Ltd.; MX-1000, volume average particle diameter 10 μm), and 0.5 part of a charge control agent (manufactured by NOF CORPORATION; ELEGAN 264 WAX) are added to 70 parts of a solution obtained by mixing cyclohexanone and methyl ethyl ketone in a weight ratio of 10 to 90. The mixture is thoroughly stirred to prepare an image receiving layer coating liquid 5.

(Manufacture of Image Transfer Sheet (Transfer Sheet 7) for Electrophotography)

To the release layer, the receiving layer coating liquid 5 is applied by using a wire bar in the same manner as in Example 3, and dried at 120° C. for 2 min to form an image receiving layer with a film thickness of 7.5 μm. Thereafter, the substrate is cut to A4 size (210 mm×297 mm) to form a transfer sheet 7. The surface resistivity of this image receiving layer is $4.1\times10^{10}\Omega$. The adhesion strength between the release layer and the image receiving layer is found to be 2.8 g/25 mm.

(Performance Evaluation of Image Transfer Sheet 7 for Electrophotography)

On the image receiving layer surface of the transfer sheet 7 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 7 in conveyance is evaluated in the same manner as in Example 1. There is no problem in conveyance as clarified in Table 1.

(Manufacture of Image Recorded Medium (Card 7))

An A4-size white sheet (manufactured by Mitsubishi Plastics, Inc.; PG-W, thickness 600 μm) made of PETG resin is used as an image supporting element. The image transfer sheets 7 having the fixed images are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 185° C. and a feed rate of 0.3 m/min (5 mm/s). After the transfer sheets 7 are cooled to room temperature, the transfer sheets 7 are peeled off the white sheet to form a card 7 (an image recorded medium 7) having the transferred images including facial photographs on the white sheet.

(Evaluation of Card 7 (Image Recorded Medium 7))

The card 7 is evaluated in the same manner as in Example 1, with respect to the fixability for toner image, image density, image quality, and friction wear resistance.

The results are shown in Table 1.

Example 6

Preparation of Image Receiving Layer Coating Liquid 6

20 parts of a polyester resin (manufactured by TOYOBO Co., Ltd.; VYLON 296), 2 parts of cross-linked acrylic particles (manufactured by Soken Chemical & Engineering Co., Ltd.; MX-2000, volume average particle diameter 20 μm), and 0.2 part of a charge control agent (manufactured by NOF CORPORATION; ELEGAN 264 WAX) are added to 80 parts of a solution obtained by mixing cyclohexanone and methyl ethyl ketone in a weight ratio of 10 to 90. The mixture is thoroughly stirred to prepare an image receiving layer coating liquid 6.

(Manufacture of Image Transfer Sheet (Transfer Sheet 8) for Electrophotography)

To the release layer, the receiving layer coating liquid 6 is applied by using a wire bar in the same manner as in Example 3, and dried at 120° C. for 2 min to form an image receiving layer with a film thickness of 15 μm. Thereafter, the substrate is cut to A4 size (210 mm×297 mm) to form a transfer sheet 8. The surface resistivity of this image receiving layer is $1\times10^{13}\Omega$. The adhesion strength between the release layer and the image receiving layer is found to be 4.7 g/25 mm.

(Performance Evaluation of Image Transfer Sheet 8 for Electrophotography)

On the image receiving layer surface of the above-mentioned transfer sheet 8 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 8 in conveyance is evaluated in the same manner as in Example 1. There is no problem in conveyance as clarified in Table 1.

(Manufacture of Image Recorded Medium (Card 8))

An A4-size white sheet (manufactured by Mitsubishi Plastics, Inc.; PG-WHIFG, thickness 760 μm) made of PETG resin is used as an image supporting element. The image transfer sheets 8 having the fixed images are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 180° C. and a feed rate of 0.3 m/min (5 mm/s). After the transfer sheets 8 are cooled to room temperature, the transfer sheets 8 are peeled off the white sheet to give a card 8 (an image recorded medium 8) having the transferred images including facial photographs on the white sheet.

(Evaluation of Card 8 (Image Recorded Medium 8))

The card 8 is evaluated in the same manner as in Example 1, with respect to the fixability of toner image, image density, image quality, and friction wear resistance.

The results are shown in Table 1.

Comparative Example 4

Preparation of Image Receiving Layer Coating Liquid 7

20 parts of an acrylic urethane resin (manufactured by Soken Chemical & Engineering Co., Ltd.; SU-100A, solid content 50% by weight), 0.1 part of cross-linked acrylic particles (manufactured by Soken Chemical & Engineering Co., Ltd.; MX-800, volume average particle diameter 8 μm), and 2 parts of a charge control agent (manufactured by NOF CORPORATION; ELEGAN 264 WAX) are added to 30 parts of a solution obtained by mixing cyclohexanone and methyl ethyl ketone in a weight ratio of 10 to 90. The mixture is thoroughly stirred to prepare an image receiving layer coating liquid 7.

(Manufacture of Image Transfer Sheet (Transfer Sheet 9) for Electrophotography)

To the release layer, the receiving layer coating liquid 7 is applied by using a wire bar in the same manner as in Example 3, and dried at 120° C. for 1 min to form an image receiving layer with a film thickness of 5 μm. Thereafter, the substrate is cut to A4 size (210 mm×297 mm) to form a transfer sheet 9. The surface resistivity of this image receiving layer is $8.6\times10^{13}\Omega$. The adhesion strength between the release layer and the image receiving layer is found to be 5.2 g/25 mm.

(Performance Evaluation of Image Transfer Sheet 9 for Electrophotography)

On the image receiving layer surface of the above-mentioned transfer sheet 9 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 9 in conveyance is evaluated in the same manner as in Example 1. There is no problem in conveyance as clarified in Table 1.

(Manufacture of Image Recorded Medium (Card 9))

An A4-size white sheet (manufactured by Mitsubishi Plastics, Inc.; PG-WHI, thickness 760 μm) made of PETG resin is used as an image supporting element. The image transfer sheets 9 having the fixed images are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 170° C. and a feed rate of 0.3 m/min (5 mm/s). After the transfer sheets 9 are cooled to room temperature, the transfer sheets 9 are peeled off the white sheet to give a card 9 (an image recorded medium 9) having the transferred images including facial photographs on the white sheet.

(Evaluation of Card 9 (Image Recorded Medium 9))

The card 9 is evaluated in the same manner as in Example 1, with respect to the fixability for toner image, image density, image quality, and friction wear resistance. However, there is a part in the card 9 where the density is lower than 1.3. Some of 4 point characters are illegible.

The results are shown in Table 1.

Example 7

Preparation of Image Receiving Layer Coating Liquid 8

40 parts of a polyester resin (manufactured by TOYOBO Co., Ltd.; VYLONAL MD-1500, solid content concentration 30% by weight), 0.6 part of cross-linked acrylic particles (manufactured by Soken Chemical & Engineering Co., Ltd.; MX-1500, volume average particle diameter 15 μm), and 0.4 part of a charge control agent (manufactured by NOF CORPORATION; ELEGAN 264 WAX) are added to 20 parts of n-butyl cellosolve. The resultant mixture is thoroughly stirred to prepare an image receiving layer coating liquid 8.

(Manufacture of Image Transfer Sheet (Transfer Sheet 10) for Electrophotography)

To the respective sides of a PET film (manufactured by Toray Industries, Inc.; LUMIRROR 100T60, thickness 100 μm) as the substrate, the release layer coating liquid 1 used in Example 1 is applied by using a wire bar, and dried at 120° C. for 30 sec to form release layers with a film thickness of 1 μm on the front and back surfaces of the substrate. To the release layers on the respective sides, the image receiving layer coating liquid 8 is applied by using a wire bar, and dried at 80° C. for 5 min to form image receiving layers with a film thickness of 10 μm on both front and back surfaces of the substrate. Thereafter, the substrate is cut to A4 size (210 mm×297 mm) to give a transfer sheet 10. The transfer sheet has a surface resistivity of 10 is $8.8\times10^{8}\Omega$ on each of the front and back surfaces.

The adhesion strength between the release layer and the image receiving layer is found to be 3.8 g/25 mm.

(Performance Evaluation of Image Transfer Sheet 10 for Electrophotography)

On the image receiving layer surfaces of the transfer sheet 10 (having no image thereon), color mirror images of images including facial photographs, names, and solid images are formed by using an image formation apparatus (a color copying machine DOCUCOLOR 1255CP manufactured by Fuji Xerox Co., Ltd.) in the same manner as in Example 1.

The traveling performance of the transfer sheet 10 in conveyance is evaluated in the same manner as in Example 1. There is no problem in conveyance as clarified in Table 1.

(Manufacture of Image Recorded Medium (Card 10))

A4-size white sheets (manufactured by Mitsubishi Plastics, Inc.; PG-WHI, thickness 500 μm) as image supporting elements made of PETG resin are superposed respectively on the front and back surfaces of the image transfer sheet 10 having the images, A laminator (manufactured by FUJIPLA Inc.; LAMIPACKER LPD3206 CITY) is used to perform lamination under the conditions of 200° C. and a feed rate of 0.3 m/min (5 mm/s). After the white sheets are cooled to room temperature, the white sheets are peeled off the transfer sheet 10 to give two cards 10 (two image recorded media 10) each having the transferred image including a facial photograph. As described above, the two cards 10 are produced from a single image transfer sheet.

(Evaluation of Card 10 (Image Recorded Medium 10))

The card 10 is evaluated in the same manner as in Example 1, with respect to the fixability for toner image, image density, image quality, and friction wear resistance.

The results are shown in Table 1.

Further, the image recorded media manufactured by using the respective image transfer sheets of Examples 1 to 6 are superior in any of the fixability, the image density, and the image quality, and are also good in quality as a card (information recording medium).

Example 8

An image transfer sheet (transfer sheet 11) for electrophotography of the present invention is manufactured. Hereinafter, the method of manufacture will be described for each process thereof.

(Manufacture of Image Transfer Sheet for Electrophotography)

—Preparation of Image Receiving Layer Coating Liquid A—

100 parts of an acrylic resin (solid content 40% by weight) (trade name: EM; manufactured by Soken Chemical & Engineering Co., Ltd.), 10 parts of cross-linked methacrylic ester copolymer particles (manufactured by Soken Chemical & Engineering Co., Ltd.; MX-1500H, volume average particle diameter 15 μm) as a matting agent, and 1.2 parts of quarternary ammonium salt (trade name: ELEGAN 264 WAX; manufactured by NOF CORPORATION) as a charge control agent are diluted by being mixed with 80 parts of methyl ethyl ketone and 20 parts of toluene, so that an image receiving layer coating liquid A is obtained.

TABLE 1

| | Transfer sheet | | | | | Image recorded medium | | | |
|---|---|---|---|---|---|---|---|---|---|
| | Image receiving layer | | | | | | | | |
| | Thickness (μm) | Particle diameter (μm) | Adhesion strength (g/25 mm) | Traveling performance | Retransferability | Fixability | Image density | Image quality | Friction wear resistance |
| Example 1 | 2 | 5 | 1.7 | A | A | A | A | A | A |
| Example 2 | 5 | 8 | 2.2 | A | A | A | A | B | A |
| Example 3 | 25 | 30 | 4.2 | A | A | A | A | A | B |
| Example 4 | 10 | 15 | 4.4 | A | A | A | A | A | A |
| Example 5 | 7.5 | 10 | 2.8 | A | A | A | A | A | B |
| Example 6 | 15 | 20 | 4.7 | A | A | A | A | B | A |
| Example 7 | 10 | 15 | 3.8 | A | A | A | A | A | A |
| Comp. Ex. 1 | — | — | — | C | C | — | — | — | — |
| Comp. Ex. 2 | 2 | — | 1.7 | C | C | A | C | D | A |
| Comp. Ex. 3 | 20 | — | 3.7 | C | C | A | C | D | B |
| Comp. Ex. 4 | 5 | 8 | 5.2 | A | B | A | B | D | A |

As is clear from Table 1, the image transfer sheets for electrophotography of Examples 1 to 7 exhibited superior traveling performance in image formation apparatus and image transferability (image density and image quality). This is because the surface resistivity on the front and back surfaces thereof is in the range of $1.0\times10^{8}$ to $1.0\times10^{13}\Omega$ at 23° C. 55% r.h., and because a release layer and an image receiving layer are formed in sequence on at least one side of the substrate, and because the image receiving layer contains particles which have a volume average particle diameter which is greater than the film thickness of the image receiving layer. On the other hand, the image transfer sheet of Comparative Example 1 exhibited insufficient performance as a transfer sheet element owing to the lack of the image receiving layer. The image transfer sheets of Comparative Examples 2 and 3 also exhibited insufficient performance as a transfer sheet element because the image receiving layer does not contain particles and because the surface resistivity is high.

—Manufacture of Image Transfer Sheet for Electrophotography—

30 g/m$^2$ of the obtained image receiving layer coating liquid A is applied to a 100 μm-thick polyethylene terephtalate (PET) substrate by using a wire bar so as to give a uniform thickness. Thereafter, the image receiving layer coating liquid A is dried at 120° C. for 10 min with a hot air drier to form an image transfer sheet for electrophotography on which a 10 μm thick image receiving layer including the acrylic resin is formed.

The image transfer sheet for electrophotography has a surface resistance of $2.5\times10^{10}\Omega$ under the conditions of 25° C. 65% r.h.

The adhesion strength of the image receiving layer to the substrate is measured in the same manner as in Example 1, and found to be 1.5 g/25 mm.

(Performance Evaluation of Image Transfer Sheet 11 for Electrophotography)

On the image receiving layer surfaces of the above-mentioned transfer sheet 11 (having no image thereon), a color mirror image of an image including a facial photograph, a name, and a solid image is formed by using an image formation apparatus (a color copying machine DOCUCOLOR 1255CP manufactured by Fuji Xerox Co., Ltd.) in the same manner as in Example 1.

The traveling performance of the transfer sheet 11 in conveyance is evaluated in the same manner as in Example 1. There is no problem in conveyance as shown in Table 2.

(Manufacture of Image Recorded Medium (Card 9))

An A4-size white sheet (manufactured by Mitsubishi Plastics, Inc.; DIAFIX, thickness 600 μm) made of PETG is used as an image supporting element. The image transfer sheets 4 having the fixed images thereon are respectively superposed on the front and rear surfaces of the image supporting element such that the image surfaces contact the white sheet. A laminator (manufactured by FUJIPLA Inc.; LAMIPACKER LPD3206 CITY) is used to perform lamination under the conditions of 170° C. and a feed rate of 0.3 m/min (5 mm/s). After the transfer sheets 4 are cooled to room temperature, the transfer sheets 4 are peeled off the white sheet to give a card 4 (an image recorded medium 4) having the transferred images including facial photographs on the white sheet.

(Evaluation of Card 11 (Image Recorded Medium 11))

The card 11 is evaluated in the same manner as in Example 1, with respect to the fixability for toner image, image density, image quality, friction wear resistance, and retransferability. The results are shown in Table 2.

The transfer sheet 13 has a surface resistivity of $5.8\times10^{9}\Omega$. The adhesion strength of the image receiving layer to the substrate is 9 g/25 mm.

Evaluation of the transfer sheet 13 is carried out in the same manner as in Example 1. The results are shown in Table 2.

Comparative Example 5

A transfer sheet 14 is manufactured in the same manner as in Example 8, except that the quarternary ammonium salt as the charge control agent and the matting agent are not used. The transfer sheet 14 has a surface resistivity of $2\times10^{16}\Omega$. The adhesion strength of the image receiving layer to the substrate is 20 g/25 mm.

Evaluation of the transfer sheet 14 is carried out in the same manner as in Example 1. The results are shown in Table 2.

Comparative Example 6

A transfer sheet 15 is manufactured in the same manner as in Example 9, except that, in place of polyester resin, a polycarbonate resin (trade name: BISPHENOL-Z, manufactured by Mitsubishi Plastics, Inc.) is used, and that the quarternary ammonium salt as the charge control agent is not used. The transfer sheet 15 has a surface resistivity of $3.9\times10^{15}\Omega$. In the measurement of the adhesion strength of the image receiving layer to the substrate, the film is so strongly adhered to the substrate that the film cannot be peeled off.

Evaluation of the transfer sheet 15 is carried out in the same manner as in Example 1. The results are shown in Table 2.

TABLE 2

| | Transfer sheet | | Image recorded medium | | | |
|---|---|---|---|---|---|---|
| | Traveling performance | Retransferability | Fixability | Image density | Image quality | Friction wear resistance |
| Example 8 | A | A | A | A | B | B |
| Example 9 | A | A | A | A | B | A |
| Example 10 | A | A | A | A | B | B |
| Comp. Ex. 5 | C | C | B | B | D | D |
| Comp. Ex. 6 | C | C | B | B | D | D |

Example 9

An image transfer sheet 12 for electrophotography is obtained in the same manner as in Example 8, except that the acrylic resin is changed to an acrylic resin (trade name: M-45C; manufactured by Soken Chemical & Engineering Co., Ltd.). The transfer sheet 12 had a surface resistivity of $3.5\times10^{10}\Omega$. The adhesion strength of the image receiving layer to the substrate is 3 g/25 mm.

Evaluation of the transfer sheet 12 is carried out in the same manner as in Example 1. The results are shown in Table 2.

Example 10

An image transfer sheet 13 for electrophotography is obtained in the same manner as in Example 8, except that, in place of the acrylic resin, polyester resin (trade name: VYLON 200; manufactured by TOYOBO Co., Ltd.) is used.

As is clear from Table 2, the image transfer sheets for electrophotography of Examples 8 to 10 have a superb traveling performance in image formation apparatus and image transferability (image density and image quality).

According to the present invention, image transfer sheets for electrophotography are provided which have an image receiving capability and transfer capability and which allows the image to be transferred to an image supporting element with good resolution and good transferability. Image recorded media and the manufacturing methods of the same are also provided. In this specification, peeling of the substrate off the image receiving layer is occasionally indicated by "peeling of the image transfer sheet (off the image supporting element)."

What is claimed is:

1. An image transfer sheet for electrophotography comprising:

a substrate, an image receiving layer provided on at least one side of the substrate on which a toner image is to be formed, and a release layer provided between the substrate and the image receiving layer;

wherein:

the substrate is plastic, the image receiving layer includes particles having a volume average particle diameter of from 15 to 30 μm, the thickness of the image receiving layer is 10 to 25 μm, the volume average particle diameter of the particles is from 1.2 times to 1.5 times the thickness of the image receiving layer, an adhesion strength of the release layer to the image receiving layer is 5 g/25 mm or less, both surfaces of the image transfer sheet have surface resistivities at 23° C. 55% r.h. which are within the range of $1.0\times10^{8}$ to $1.0\times10^{13}\Omega$, and the toner image and the image receiving layer are to be transferred together to an element.

2. The image transfer sheet for electrophotography according to claim 1, wherein an adhesion strength of the image receiving layer to the substrate is 10 g/25 mm or less.

3. The image transfer sheet for electrophotography according to claim 1, wherein the image receiving layer further includes a resin.

4. The image transfer sheet for electrophotography according to claim 3, wherein the resin is a thermoplastic resin.

5. The image transfer sheet for electrophotography according to claim 1, wherein the image receiving layer further includes at least one selected from a charge controlling agent, an antimicrobial agent, an ultraviolet ray absorber, or an antioxidant.

6. The image transfer sheet for electrophotography according to claim 1, wherein the image receiving layer further includes at least one resin selected from a polyester resin, an acrylic resin, or a polyvinyl acetal resin.

7. An image recorded medium obtained by a process comprising:

providing an image transfer sheet for electrophotography comprising a substrate, an image receiving layer provided on at least one side of the substrate on which image forming material is to be formed, and a release layer between the substrate and the image receiving layer;

electrophotographically forming a mirror image of a desired image made of an image forming material on the image receiving layer of the image transfer sheet;

adhering the image receiving layer to an image supporting element by heat and pressure such that the mirror image contacts the image supporting element; and after cooling and solidification of the image forming material, peeling the substrate off the image receiving layer so as to transfer the image forming material to the image supporting element, wherein:

the image supporting element is a plastic sheet, the image receiving layer includes particles having a volume average particle diameter of from 15 to 30 μm, the thickness of the image receiving layer is 10 to 25 μm, the volume average particle diameter of the particles is from 1.2 times to 1.5 times the thickness of the image receiving layer, an adhesion strength of the release layer to the image receiving layer is 5 g/25 mm or less, and both surfaces of the image transfer sheet have surface resistivities at 23° C. 55% r.h. which are within the range of $1.0\times10^{8}$ to $1.0\times10^{13}\Omega$.

8. An image recorded medium according to claim 7, wherein at least a side of the image supporting element which side has the transferred image thereon comprises a vinyl chloride resin, a polycarbonate resin, or a polyester resin including ethylene glycol, terephthalic acid, or 1,4-cyclohexanedimethanol as a copolymer component.

9. An image recorded medium according to claim 7, wherein the image supporting element comprises an information chip from which information can be retrieved by at least one of an electric system, a magnetic system, and an optical system.

10. An image recorded medium according to claim 9, wherein the information chip is an IC chip.

11. An image recorded medium according to claim 9, wherein the information is variable information.

12. An image recorded medium according to claim 11, wherein the variable information is personal information.

13. A method for manufacturing an image recorded medium, the method comprising:

providing an image transfer sheet for electrophotography comprising a substrate, an image receiving layer provided on at least one side of the substrate on which image forming material is to be formed, and a release layer between the substrate and the image receiving layer;

electrophotographically forming a mirror image of a desired image made of an image forming material on the image receiving layer of the image transfer sheet;

superposing the image transfer sheet on an image supporting element such that the mirror image contacts the image supporting element;

adhering the image receiving layer to the image supporting element by heat and pressure; and after cooling and solidification of the image forming material, peeling the substrate off the image receiving layer so as to transfer the image forming material to the image supporting element, wherein:

the substrate is plastic, the image receiving layer includes particles having a volume average particle diameter of from 15 to 30 μm, the thickness of the image receiving layer is 10 to 25 μm, the volume average particle diameter of the particles is from 1.2 times to 1.5 times the thickness of the image receiving layer, an adhesion strength of the release layer to the image receiving layer is 5 g/25 mm or less, and both surfaces of the image transfer sheet have surface resistivities at 23° C. 55% r.h. which are within the range of $1.0\times10^{8}$ to $1.0\times10^{13}\Omega$.

14. The method according to claim 13, wherein two image transfer sheets are superposed on both sides of the image supporting element such that the images from each image transfer sheet respectively contact the opposite sides of the image supporting element.

15. A method for manufacturing two image recorded media from a transfer sheet for electrophotography, the method comprising:

providing an image transfer sheet for electrophotography comprising a substrate, image receiving layers provided on both sides of the substrate on which image forming material is to be formed, and release layer between the substrate and the image receiving layers;

electrophotographically forming mirror images of desired images made of an image forming material on both sides of the image transfer sheet for electrophotography;

superposing two image supporting elements on both sides of the image transfer sheet for electrophotography such that the image supporting elements respectively contact the opposite sides of the image transfer sheet;

adhering the image receiving layers to the image supporting elements by heat and pressure; and after cooling and solidification of the image forming material, peeling the image receiving layers off the substrate so as to transfer the image forming material to the image supporting elements, wherein:

the substrate is plastic, the image receiving layer includes particles having a volume average particle diameter of from 15 to 30 μm, the thickness of the image receiving layer is 10 to 25 μm, the volume average particle diameter of the particles is from 1.2 times to 1.5 times the thickness of the image receiving layer, an adhesion strength of the release layer to the image receiving layer is 5 g/25 mm or less, and both surfaces of the image transfer sheet have surface resistivities at 23° C. 55% r.h. which are within the range of $1.0\times10^{8}$ to $1.0\times10^{13}\Omega$.

* * * * *